US005584598A

United States Patent [19]

Watanabe et al.

[11] Patent Number: 5,584,598

[45] Date of Patent: Dec. 17, 1996

[54] CONCRETE-FLOOR FINISHER

[75] Inventors: Hiromitsu Watanabe; Noriyuki Takeuchi; Tetsuya Arimoto; Atsushi Yamashiro, all of Tokyo, Japan

[73] Assignee: Tokimec Inc., Tokyo, Japan

[21] Appl. No.: 547,314

[22] Filed: Oct. 24, 1995

[51] Int. Cl.[6] ..... E01C 19/22

[52] U.S. Cl. ..... 404/112; 404/84.1; 404/119

[58] Field of Search ..... 404/72, 75, 93, 404/96, 97, 112, 117, 119, 120, 84.1; 175/45; 425/456

[56] References Cited

U.S. PATENT DOCUMENTS

| | | | |
|---|---|---|---|
| 4,046,484 | 9/1977 | Holz, Sr. et al. | 404/112 |
| 4,775,306 | 10/1988 | Kikuchi et al. | 425/62 |

FOREIGN PATENT DOCUMENTS

| | | |
|---|---|---|
| 63-130860 | 6/1988 | Japan . |
| 4261960 | 9/1992 | Japan . |
| 55357 | 1/1993 | Japan . |
| 693729 | 4/1994 | Japan . |

*Primary Examiner*—Tamara L. Graysay
*Assistant Examiner*—Pamela A. O'Connor
*Attorney, Agent, or Firm*—Ladas & Parry

[57] ABSTRACT

A concrete-floor finisher includes a plurality of rotary shafts (28) supported on a supporting plate (2) of a machine proper (1) so as to be tiltable in x and y directions and rotatable opposite to each other, and a plurality of blades (12*a* to 12*d*) radially arranged relative to a rotor (10) at the lower part of each of the rotary shafts and respectively held in place by a plurality of fitting members (13), and a rocking supporting unit (14) for the fitting member of each blade is composed of a fixed plate (15) attached to the upper surface of the blade, a holding member (16) attached to the vertical plate portion of the fixed plate, a bearing (18) pivotally supporting substantially the central portion of the holding member (16) by a supporting pin (17) extended in the tangential direction of the circle of rotation, and means for fitting a square cylindrical portion (19) of the bearing onto the forward end of the fitting member and removably fixing in place with a bolt (21) or the like, thus ensuring 20° freedom of vertical rocking movement for each of the blades and thereby bringing the blades into parallel contact with the concrete.

15 Claims, 23 Drawing Sheets

CONCRETE-FLOOR FINISHER

BACKGROUND OF THE INVENTION (a) Field of the Invention

The present invention relates to a finisher for smoothly finishing the surface of a concrete floor while moving the machine proper on the floor subjected to concrete placing and more particularly to such finisher which is applicable to both the unmanned automatic operation system capable of freely performing the work by automatic operation or remote operation without manning the machine and the manned manual operation system adapted for manning the machine to perform the work by manual operation.

(b) Description of the Prior Art

In view of the problems encountered with such concrete-floor finisher of the manned manual operation system as disclosed in Japanese Laid-Open Patent Application No. 63-130860, e.g., the increased weight, the deteriorated operability and the increased labor and longer term of operation, the inventors have made efforts toward the development of an unmanned-type machine capable of automatic operation and its basic construction has been made known by Japanese Laid-Open Patent Applications No. 4-261960, No. 5-5357 and No. 6-93729.

This concrete-floor finisher of the unmanned automatic operation system includes a pair of rotors each having a plurality of radially attached blades (or otherwise referred to as trowels) and the rotary shaft of each rotor is tiltably mounted on the machine proper. The machine proper is supported on a concrete flower surface by the plurality of blades whereby the rotary shafts of the pair of rotors are each tilted in a given direction while rotating the blades by the rotors in the opposite directions so as to increase the pressure exerted on the concrete floor surface by each blade and generate a propulsive force in the opposite direction to the rotational direction of the blade existing in the position of the increased pressure thereby causing the machine proper to move or turn in a given direction so as to smoothly finish the concrete floor surface. This travelling principle is the same with the manned manual operation system.

However, the condition of the placed concrete floor surface is not uniform but involves irregularities, slopes or inclines, undulations, etc., with the result that any effort to move the machine proper straight ahead tends to cause the machine proper to turn in any given direction or make a turning motion. As a result, an attempt has been made to ensure the straight-forwardness of the movement by providing the operating rod or the rotary shafts with any tilting correction amounts of the cancelling directions and this operation has been found to be extremely difficult.

In addition, the travelling performance, moving controllability or operability of the machine proper, the finishing quality of the concrete floor surface, etc., have been greatly influenced by the methods of arrangement of the blades disposed on the right and left rotors, particularly the pressure points where the pressures exerted on the concrete floor due to the tilting of the blades (hereinafter referred to as the points of application of pressure).

As shown in FIGS. 16*a*–16*d*, for example, if the blades 12*a* to 12*d* of the right and left rods are arranged apart so that their outer peripheral circles (or the rotational paths of the outer peripheral ends of the blades) 12*e* do not cross each other as shown in FIG. 16*a*, although the travelling performance is stabilized, there results a gap between the right and left blade outer peripheral circles 12*e* so that an unfinished part is left in this portion and it is required to repeatedly move the machine proper a number of times thus requiring an extremely long finishing time. Thus, the usual practice is to arrange the right and left blades in such a manner that their outer peripheral circles 12*e* cross each other as shown in FIG. 16*b* or FIG. 16*c*. In this case, if the amount of crossing of the blade outer peripheral circles 12*e* is small as shown in FIG. 16*b*, a projection portion 100 of the stripe-like raised concrete is caused in the central portion (FIG. 16*d*) thus ruining the finishing quality. On the other hand, if the amount of crossing of the blade outer peripheral circles 12*e* is increased considerably as shown in FIG. 16*c*, while no such projection portion as mentioned above is caused, the travelling performance becomes unstable and also the mobile control and operation become difficult. Since the condition of the concrete surface involves irregularities, slopes, etc., as mentioned previously, the straight-ahead travelling performance is deteriorated and the machine proper is caused to turn to the left or right. While a corrective turning is imparted to the machine proper for correcting such turning movement, the turning performance of the machine proper is greatly dependent on the positions of the points application of the blades and thus these control and operation are extremely difficult.

In view of these circumstances, irrespective of the manned type and the unmanned type, the conventional concrete-floor finishers have the disadvantages of being difficult to operate and requiring a long period of time (about one year) for the training of operators.

SUMMARY OF THE INVENTION

Present invention has been made to overcome the foregoing deficiencies and it is an object of the invention to provide a concrete-floor finisher which ensures easy travelling operation and control for its machine proper irrespective of the manned type and the unmanned type.

In accordance with one aspect of the present invention there is thus provided a concrete-floor finisher including:

a supporting plate, a plurality of rotary shafts each supported on the supporting plate so as to allow its vertical axis to be tilted relative thereto, the rotary shaft being rotatable in the opposite directions relative to each other, a fitting member for holding each of a plurality of blades radially arranged relative to a rotor at the lower part of each of the rotary shafts, and blade supporting means for coupling each of the blades to its fitting member in such a manner that substantially the central portion of the radial width of the blade is supported by the blade supporting means and the blade is rockably supported by a pin extended tangentially to the rotational circle of the supporting point of the blade.

By virtue of this construction, the radial outer and inner side portions of each blade are allowed to freely rock or sway vertically about the supporting pin and a freedom of vertical rocking movement is imparted to each blade by such blade supporting means, with the result that the blade is always brought into contact in parallel with the concrete floor surface irrespective of the tilting of the rotary shaft and a uniform distributed load acts on the blade. As a result, the point of pressure application position is shifted toward the center of rotation so that it is now possible to obtain a greater torque of turning and the turning performance of the machine proper is enhanced. Thus, a concrete-floor finisher is provided which ensures improved controlling and operating characteristics for the travelling operation and turning operation of the machine proper.

In accordance with another aspect of the present invention, the blade supporting means comprises means detachable as a unit with the blade from the fitting member. Since the blade is easy to wear and also there is the danger of scattered freshly mixed concrete depositing on the bearing portion of the blade supporting means thus deteriorating the previously mentioned functions, it is arranged so that the supporting means can be simply changed along with the blade to cope with such situation.

In accordance with another aspect of the present invention the concrete-floor finisher includes:

the fitting members each made of a bent member, the blade supporting means each coupled to the forward end of one of the fitting members, a bearing mounted on the lower surface of a base plate attached to each of the rotary shafts so as to rotatably support the bent portion of each fitting member, a rotor shaft coupled to each of the rotary shafts so as to be vertically slidable and to transmit the rotation to the rotary shaft, thereby vertically moving the rotor below the base plate, a circular groove formed in the outer periphery of each of the rotors, an arm means for slidably fitting the free end of each fitting member in the circular groove of the rotor.

The contact angle of each blade must be varied in accordance with the hardness of the concrete floor surface and the machine has such construction to meet this requirement. As a result, the fitting member made of a bent member rotates about the pivot at its bent portion and therefore the inclination angle of the blade can be set freely. In addition, even if the inclination angle of the blade is changed, the previously mentioned freedom of rocking movement is ensured by the blade supporting means.

In accordance with still another aspect of the present invention the concrete-floor finisher further includes:

X-rocking means for tilting each of the rotary shafts in the x direction,

Y-rocking means for tilting each of the rotary shafts in the y direction, heading detecting means for detecting the heading of the machine proper, and control means responsive to a signal from the heading detecting means to correct the amount of turning deviation of the machine proper from a predetermined heading and thereby to apply a corrected control signal to at least one of the rocking means of the X-rocking means and the Y-rocking means.

There are cases where turning sliding of the machine proper is caused even if an attempt is made to cause the machine proper to travel straight ahead and the required corrective operation for such case is difficult as mentioned previously. In accordance with the present invention the heading detecting means is provided so that the amount of deviation in the heading (the turning angle or the turning angular velocity) of the machine proper is detected by the heading detecting means and in response to the resulting detection signal the control means applies a control signal to at least one of the plurality of rocking means to correct the amount of deviation thus correcting the tilting of the rotary shaft in the x direction and/or the y direction and thereby automatically maintaining the heading constant. Thus, there results a concrete-floor finisher which is excellent in control and operating characteristics.

In accordance with the present invention, when designing the arrangement of the blades, it is assumed that the designing is effected by using the performance index J shown below. In other words, let us give the performance index J for evaluating the turning performance of the machine proper by the following equation $$J = R\left(\frac{L^2}{4} - R^2\right)$$

Where R: the radius of the rotational circle of the points of application of the blades which are exerted on the concrete floor surface and it is a variable given by $0 \leqq R \leqq 1$.

L: the center distance between the two rotary shafts and L=2.

The blades are arranged so that the value of the performance index J assumes one which is greater than 0.127 and smaller than the maximum value. Preferably the value of J is selected not less than 0.205. By arranging the blades in this way, the torque of turning is increased markedly thus greatly contributing to the previously mentioned corrective operation. Also, due to the fact that the outer peripheral circles of the right and left sets of blades no longer cross each other and an unfinished area is left on the finished surface when the value of J is close to the maximum, the value of J is set to one which is less than the maximum value.

In accordance with still another aspect of the present invention there is provided a concrete-floor finisher including:

a supporting plate, a plurality of rotary shafts each supported on the supporting plate in such a manner that its vertical axis is tiltable relative to the supporting plate, the rotary shafts being rotatable in the opposite directions to each other, a plurality of blades each radially attached through a fitting member to a rotor at the lower part of each of the rotary shaft, X-rocking means for tilting each of the rotary shafts in the x direction, Y-rocking means for tilting each of the rotary shafts in the y direction, heading detecting means for detecting the heading of a machine proper, and control means responsive to a signal from the heading detecting means to correct the amount of deviation in the turning of the machine proper from a predetermined heading and thereby to apply a corrected control signal to at least one of the plurality of rocking means of the x-rocking means and the Y-rocking means.

This construction is sufficient in the event that the heading of the machine proper is simply maintained automatically. Also, a north-seeking or compass gyroscope, on consisting of a vibratory gyro and an integrating circuit, a magnetic heading sensor or an optical fiber gyroscope is used for the heading detecting means.

In accordance with still another aspect of the present invention the concrete-floor finisher further includes receiving means for receiving a command signal from a transmitting means through remote operation, and means for feeding back a turning angular velocity signal generated from the heading detecting means to a turning angular velocity command signal applied to the control means by the transmitting means through the receiving means to make a comparison for the purpose of correcting the heading of the machine proper.

Where a variation is caused in the turning velocity due to a disturbance during the turning operation of the machine proper, the heading detecting means detects the turning velocity, generates it as a turning angular velocity signal, and feeds back the turning angular velocity signal to the comparison means whereby the comparison means determines its deviation from the turning angular velocity command signal from the receiving means and the control means controls the tilting of the rotary shafts in accordance with the deviation signal, thereby effecting the turning angular velocity control proportional to the operational angle of the stick of the transmitting means irrespective of any disturbance. Thus, there is the effect of causing the concrete-floor finisher to perform a stable turning operation irrespective of irregularities, slopes, etc., in the concrete floor surface, if any.

DESCRIPTION OF THE PREFERRED EMBODIMENTS

Embodiments of the present invention will now be described by taking the case of the unmanned automatic operating system.

Embodiment 1

Figure 1:
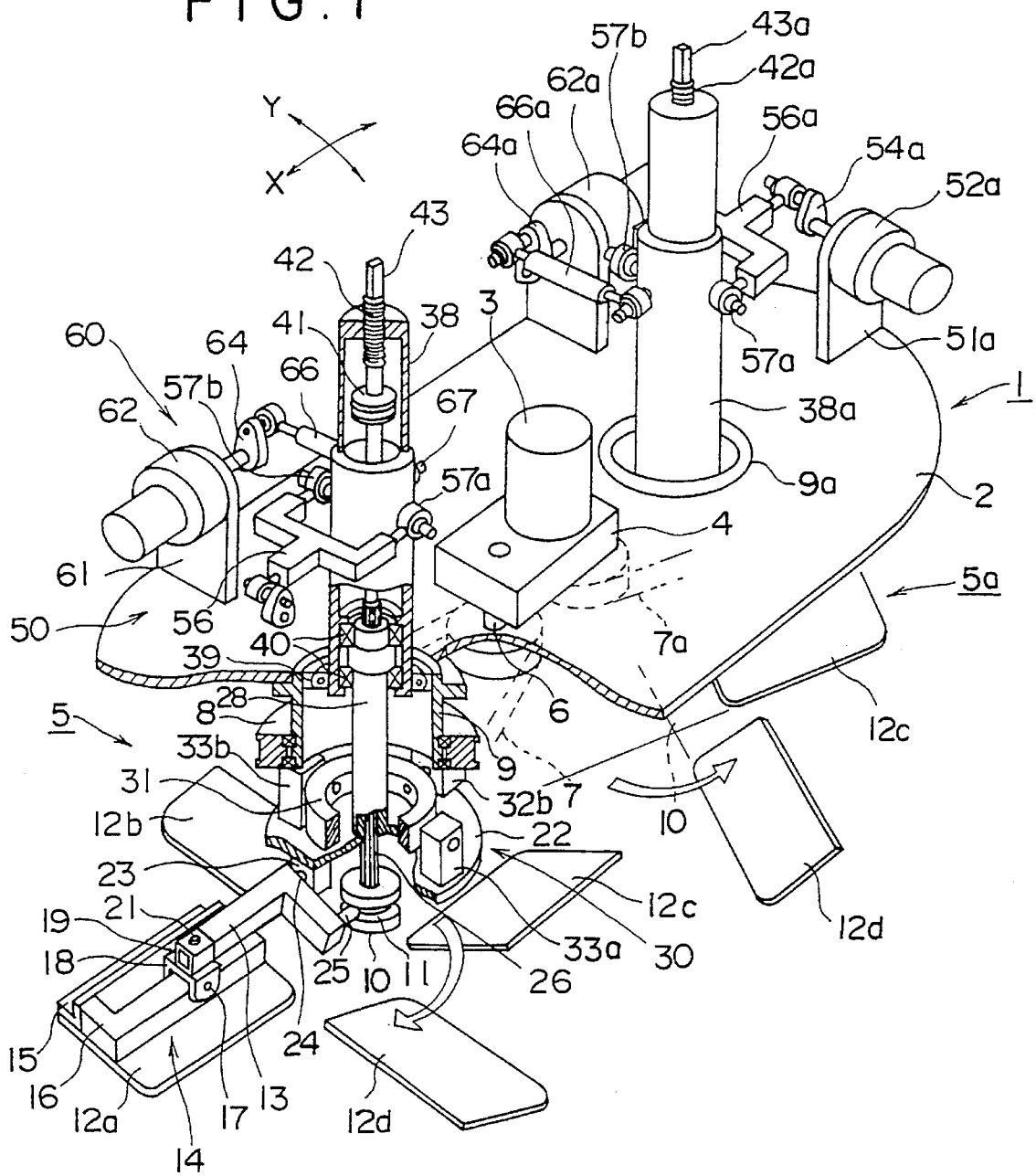
FIG. 1 is a schematic perspective view showing partly in section a first embodiment of the present invention.
Figure 2:
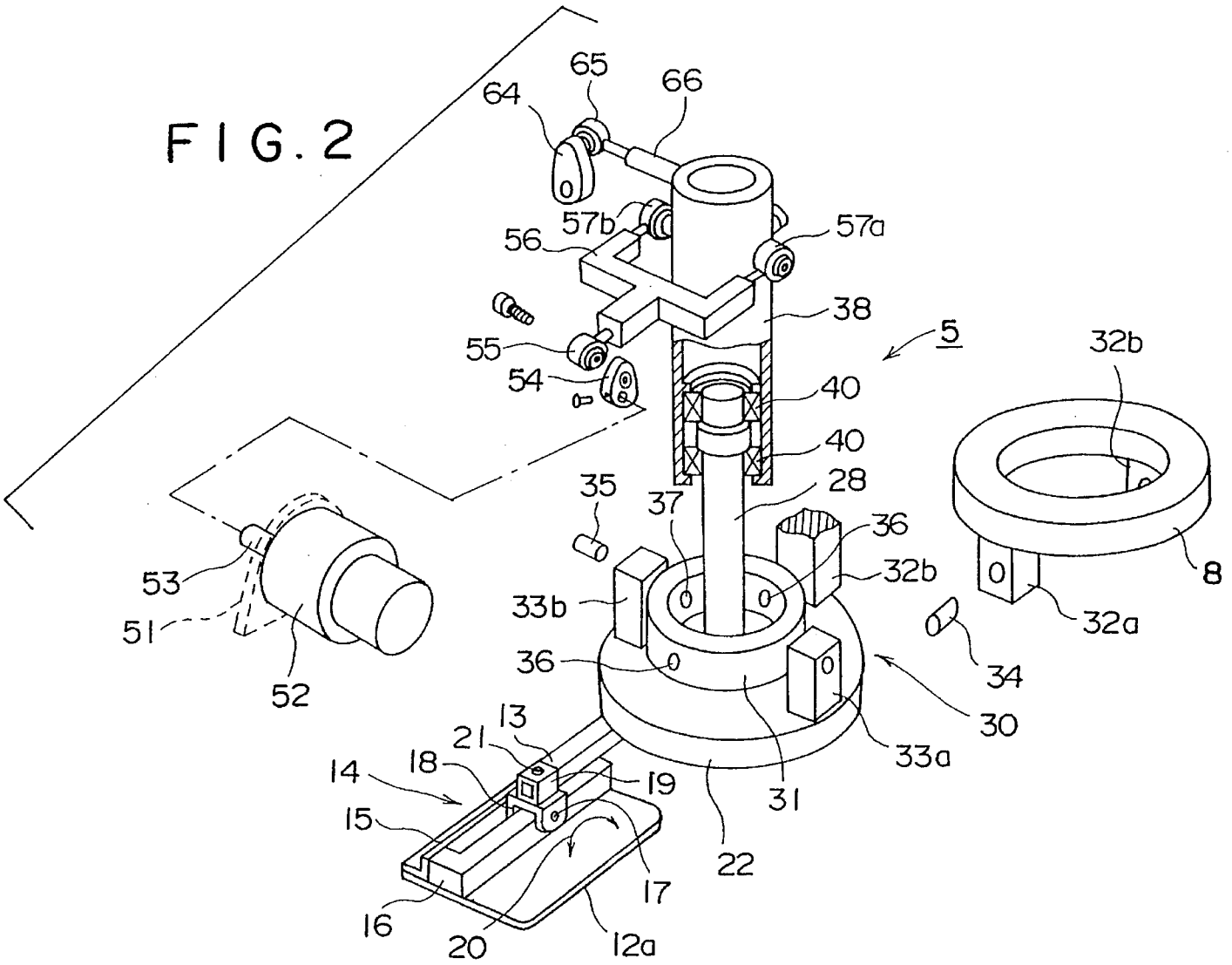
FIG. 2 is an exploded perspective view showing partly in section the principal part of the blade driving mechanism on the left side of FIG. 1.
Figure 3:
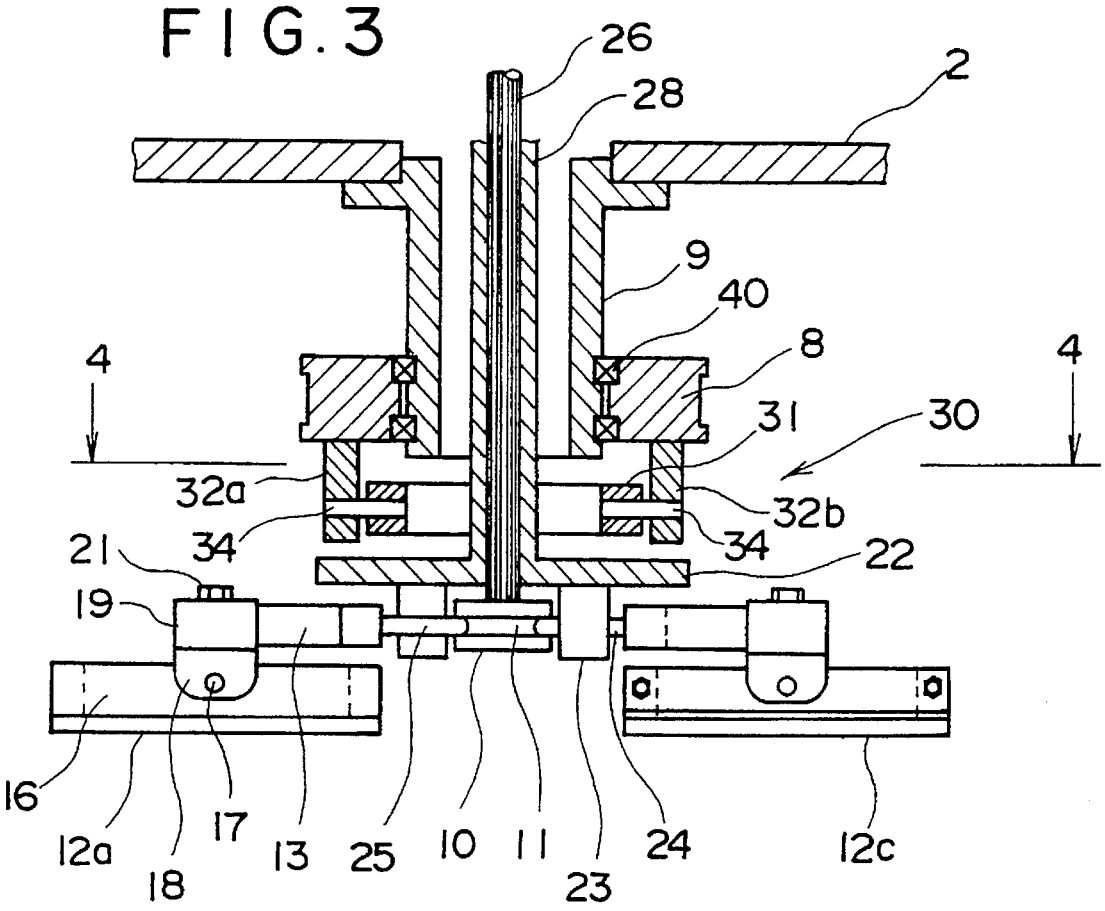
FIG. 3 is a sectional view showing the details of the blade supporting mechanisms and the gimbal mechanism in FIG. 2.

Referring to FIGS. 1 to 4, the first embodiment will be described. In the Figures, numeral 1 designates a machine proper, 2 a supporting plate, 3 a driving source such as a motor or engine mounted on the upper surface of the supporting plate 2, 4 a clutch reduction gear, and 5, 5*a* blade driving mechanisms arranged on the sides of the motor 3. The output shaft of the motor 3 is substantially vertically projected through the lower surface of the supporting plate 2 and coupled through transmission mechanisms to driving shafts 6 and 6*a* (here the driving shaft 6*a* is not shown) which in turn are respectively connected through belts 7 and 7*a* to pulleys 8 and 8*a* (here the pulley 8*a* is not shown) of the blade driving mechanisms 5 and 5*a* that are positioned below the supporting plate 2. In this case, transmission means such as chains or gear units may be used in place of the belts 7 and 7*a*. Numerals 9 and 9*a* designate cylindrical members which are fastened to the supporting plate 2 so as to respectively rotatably support the pulleys 8 and 8*a* through bearings below the supporting plate 2 as shown in FIG. 3. It is to be noted that the blade driving mechanisms 5 and 5*a* are substantially the same in construction and thus the blade driving mechanism 5 will now be explained mainly.

Numeral 10 designates a rotor arranged below the supporting plate 2 and formed with a circular groove 11 in the outer periphery thereof. Radially arranged relative to the rotor 10 are blades 12*a*, 12*b*, 12*c* and 12*d* which are each constructed so that substantially the central portion of the radial width of each blade is supported by a rocking supporting unit 14 which is detachably fitted on the forward end of an L-shaped fitting member 13 and also this support is such that the radial outer and inner portions of the blade are vertically rockable about this supporting point. The rocking supporting unit 14 includes a fixed plate 15 consisting of an angle member and fastened to the upper surface of the blade 12*a*, 12*b*, 12*c* or 12*d*, a channel-shaped holding member 16 fastened to the vertical plate portion of the fixed plate 15, a bearing 18 pivotally mounted on substantially the central portion of the holding member 16 by a supporting pin 17 extended tangentially to the circle of rotation, and means for fitting a square tubular portion 19 of the bearing 18 onto the forward end of the fitting member 13 and removably fitting in place by a bolt 21 or the like. As the result, each of the blades is supported so as to be vertically rockable about the supporting pin 17. Also, each of the blades tends to wear easily and therefore it is reasonable that the rocking supporting unit 14 is made removably mountable, along with the blade, on the fitting member 13. In FIG. 2, an arrow 20 indicates the freedom of rocking movement of the rocking supporting unit 14.

On the other hand, the bent portion of the fitting member 13 is pivoted by a pin 24 to a bearing 23 mounted on the lower surface of a base plate 22 which will be described later, and the forward end of an arm 25 connected to the free end of the fitting member 13 is slidably fitted in the circular groove 11. Thus, as will be described later, it is possible to cause the blades 12*a* to 12*d* to tilt as the result of the vertical movement of the rotor 10 thereby varying the angles of the blades simultaneously and through the same angle. Also, the rotor 10 is integrally mounted on the lower end of a rotor shaft 26 whose outer peripheral surface is splined.

Numeral 28 designates a rotary shaft formed with a spline nut in its inner peripheral surface and the rotor shaft 26 is disposed so as to vertically slidably extends through the rotary shaft 28, thereby transmitting its rotation to the rotor shaft 26 and allowing the vertical movement of the rotor shaft 26. The rotary shaft 28 is disposed within a cylindrical member 9 and it is constructed so that the dislike base plate 22 is fixedly mounted on the lower end of the rotary shaft 28 and the lower end of the rotary shaft 28, which is tiltable in the x and y directions, is supported by a gimbal mechanism 30 which will be described below.

Figure 4:
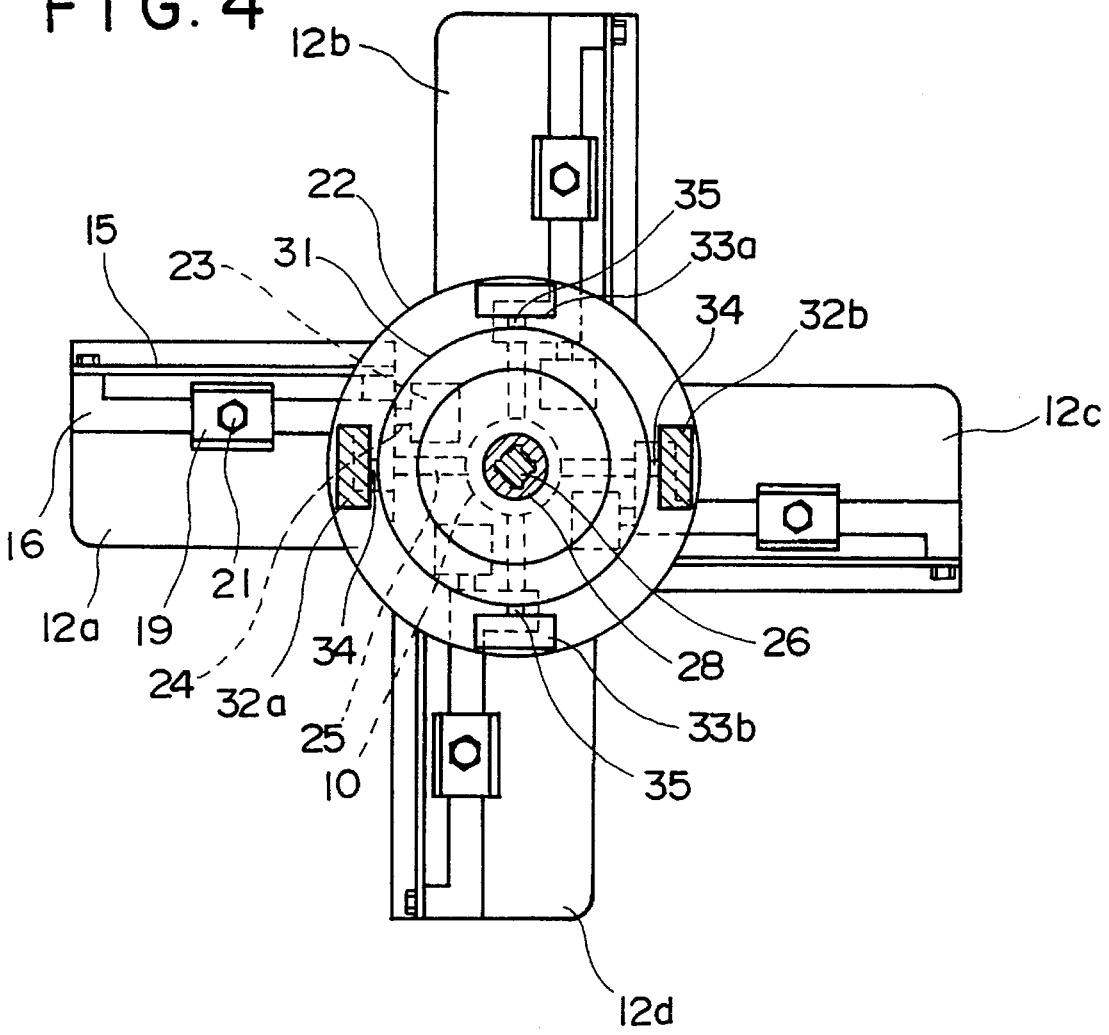
FIG. 4 is a sectional view taken along the line 4—4 of FIG. 3.

FIGS. 3 and 4 show the details of the gimbal mechanism 30. More specifically, numeral 31 designates a gimbal ring constituting a principal component of the gimbal mechanism 30 and it is arranged above the base plate 22 so as to enclose the lower end portion of the rotary shaft 28. Numerals 32*a* and 32*b* designate gimbal X-bearings depending from the lower surface of the pulley 8 in opposition to each other so as to pivotably support X-axis pins 34 and thereby to support the rotary shaft 28 through the gimbal ring 31 thus allowing the rotary shaft 28 to rock about the x axis. Numerals 33*a* and 33*b* designate gimbal Y-bearings vertically mounted on the upper surface of the base plate 22 in opposition to each other so as to pivotally support Y-axis pins 35 coupled to the gimbal ring 31 and thereby to support the rotary shaft 28 through the gimbal ring 31 thus allowing the rotary shaft 28 to rock about the y axis. Numerals 36 and 37 designate holes formed orthogonally through the side surface of the gimbal ring 31 for fitting the pivot pins 34 and 35, respectively. In this way, the pulley 8 and the base plate 22 are coupled through the gimbal ring 31 supported by the pivot pins 34 and 35 which are arranged crosswise, thus allowing the rotary shaft 28 and the rotor shaft 26 to tilt in the x and y directions, respectively.

Numeral 38 designates a cylindrical rocking shaft having its lower portion positioned within the cylindrical member 9 and extended coaxially along with the rotary shaft 28, and the lower end of the rocking shaft 38 is rockably supported in the cylindrical member 9 through a spherical bearing 39. In addition, the upper end of the rotary shaft 28 is rotatably supported within the lower end portion of the rocking shaft 38 through bearings 40, and the upper end of the rotor shaft 26 extended upwardly through the rotary shaft 28 is connected through a thrust bearing 41 to an adjusting screw 42 threadedly fitted into the upper end of the rocker shaft 38. Numeral 43 designates an angle adjusting portion at the head of the adjusting screw 42. It is to be noted that while the angle adjusting portion 43 is rotated manually, it may be rotated by a motor.

Figure 5:
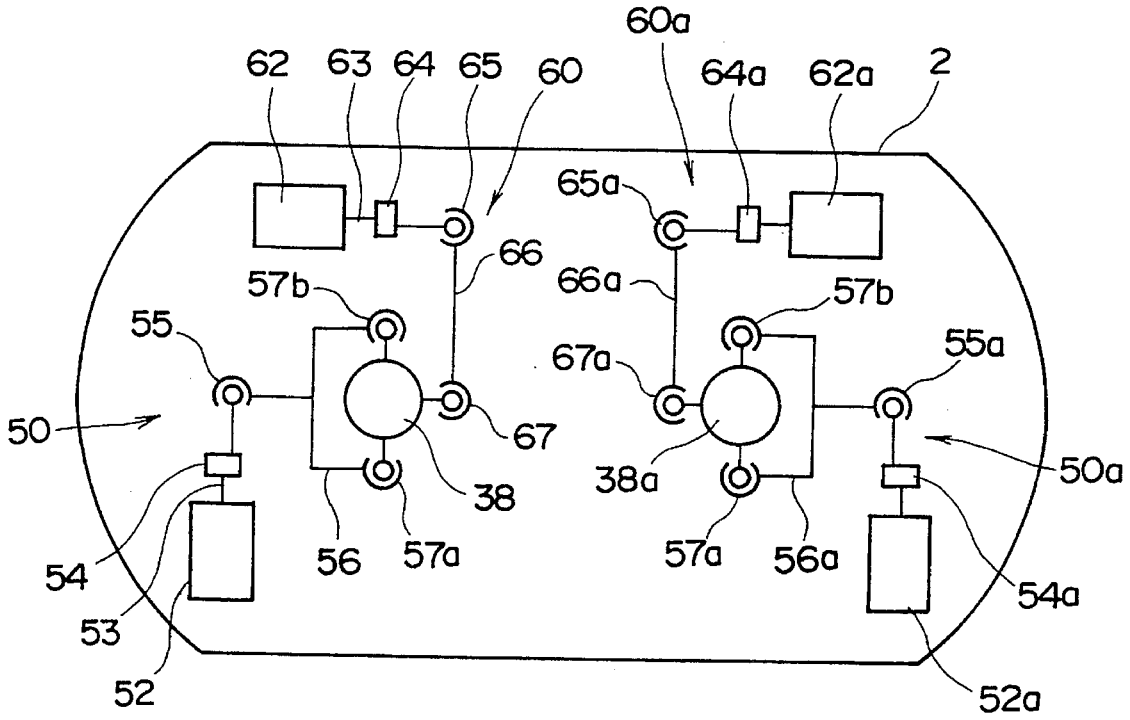
FIG. 5 is a top view showing the rocking mechanisms of FIG. 1 in simplified form.

Numeral 50 designates an X-rocking mechanism of the rocking shaft 38. As shown in FIGS. 2 and 5, the X-rocking mechanism 50 is constructed so that an X-servomotor 52 is mounted on the supporting plate 2 through a bracket 51 and an output shaft 53 of the servomotor 52 is connected to a Y-shaped servo ring 56 through a toggle servo lever 54 and a spherical bearing 55, with the ends of the forward portion of the servo ring 56 being rotatably attached to the rocking shaft 38 through spherical bearings 57*a* and 57*b*.

Numeral 60 designates a Y-rocking mechanism of the rocking shaft 38. The Y-rocking mechanism 60 is constructed so that an Y-servomotor 62 is mounted on the supporting plate 2 through a bracket 61 and an output shaft 63 of the servomotor 62 is connected to an I-shaped servo ring 66 through a toggle servo lever 64 and a spherical bearing 65, with the forward end of the servo ring 66 being rotatably mounted on the rocking shaft 38 through a spherical bearing 67 arranged perpendicular to the axes of the spherical bearings 57*a* and 57*b*.

It is to be noted that in FIG. 1 the other rocking shaft 38*a* is also provided with an X-rocking mechanism 50*a* and a Y-rocking mechanism 60*a* respectively comprising an X-servomotor 52*a* and a Y-servomotor 62*a* of the same constructions as mentioned previously. On the other hand, in the case of the manned manual operation system each rocking shaft itself constitutes a control rod and the operation is effected by holding the handle mounted on the control rod.

With the embodiment constructed as described above, as the motor 3 is operated, its rotation is transmitted to the pulley 8 through the belt 7 and the pulley 8 is rotated. The rotation of the pulley 8 is transmitted to the base plate 22 through the gimbal mechanism 30. The rotation of the base plate 22 is transmitted to the rotor 10 through the rotor shaft 26 splined to the rotary shaft 28 which is integral with the base plate 22 whereby while integrally rotating the rotor 10, the blades 12*a* to 12*d* are rotated by the fitting members 13 attached to the rotor 10 and the base plate 22 through the arms 25 and the bearings 23, respectively, and the rocking supporting units 14.

It is to be noted that while the blades 12*a* to 12*d* of the other blade driving mechanism 5*a* are rotated in the like manner, their directions of rotation are respectively opposite to the blades 12*a* to 12*d* of the blade driving mechanism 5.

When finishing the concrete floor surface, if the concrete is soft, considerably increasing the pressure of the blades 12*a* to 12*d* contacting with the work surface tends to roughen the work surface and therefore the pressure must be decreased. On the contrary, when the concrete is gradually solidified, if the pressure is excessively low, no effect is produced and therefore the pressure must be increased. As a result, depending on the circumstances, etc., of the work surface, the pressure of the blades 12*a* to 12*d* contacting with the work surface must be adjusted. For this purpose, the angle adjusting portion 43 of the adjusting screw 42 is rotated to move the adjusting screw 42 upward or downward and thus the rotor shaft 26 and the rotor 10, which are connected to the screw 42, are moved upward or downward. At this time, the base plate 22 is held in place so that as a result of the vertical movement of the rotor 10, the arms 25 engaging with the circular groove 11 of the rotor 10 rotate about the pins 24 of the bearings 23 and the angle of the fitting members 13 is varied and the contact positions and the contact areas of the blades 12*a* to 12*d* with respect to the work surface are varied, thereby adjusting the pressure applied on the work surface.

Next, the principle of movement for moving the machine proper 1 will be described.

Figure 6:
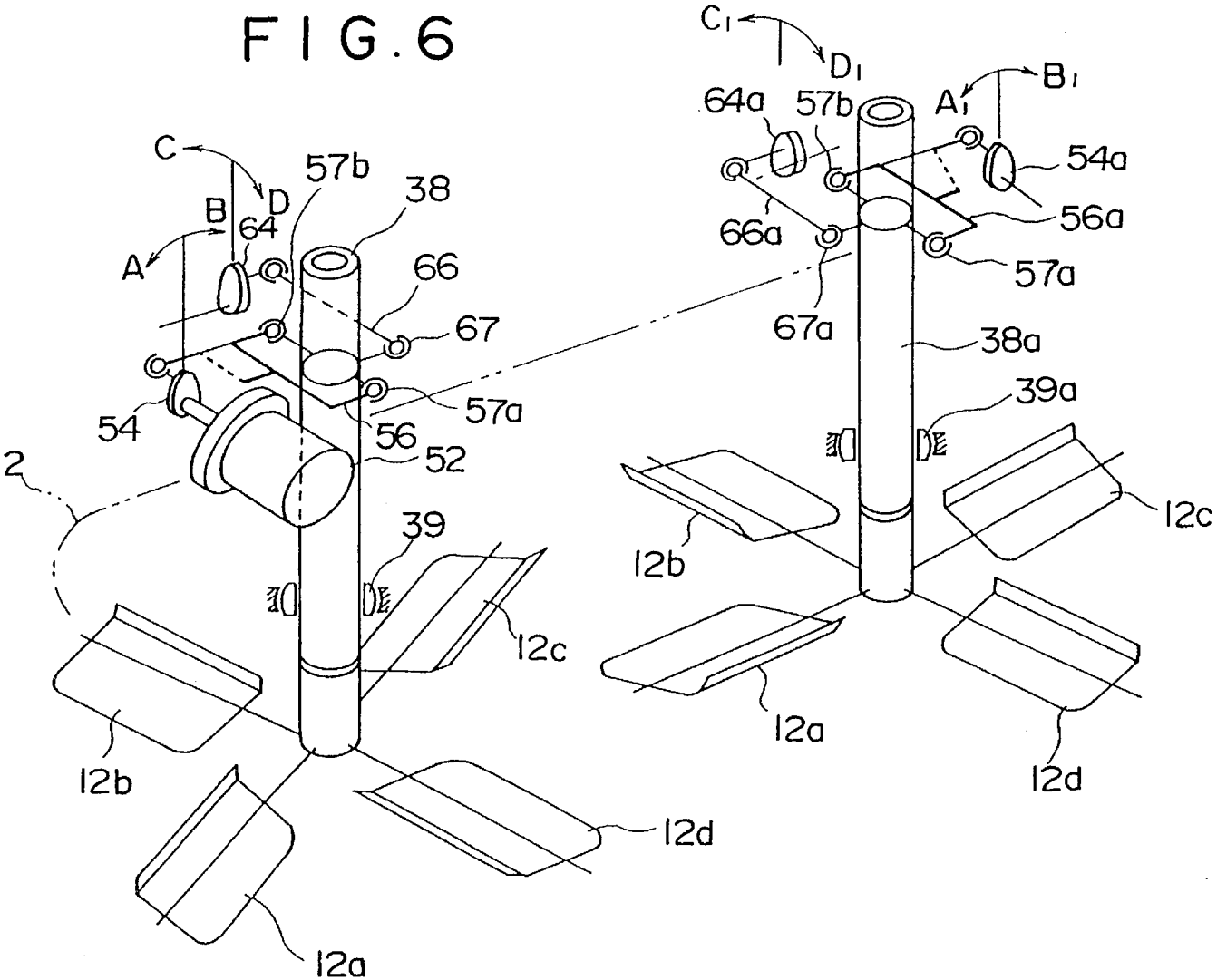
FIG. 6 is a diagram useful for explaining the operation of the first embodiment.

In FIGS. 2 and 6, when the X-servomotor 52 is rotated in the forward or reverse direction and the servo link 56 is pulled or forced in the direction A or B, the rocking shaft 38 connected to it is tilted about the supporting portion or the gimbal mechanism 30 in the direction A or B. At the lower end of the rotary shaft 28 supported coaxially along with the rocking shaft 38, the gimbal mechanism 30 is composed of the gimbal ring 31, the gimbal X-bearings 32*a* and 32*b*, the gimbal Y-bearings 33*a* and 33*b* and the pivot pins 34 and 35. As a result, the rotor shaft 26 and the base plate 22 are tilted in the direction A or B thereby varying the A-direction or B-direction tilt angle of the blades 12*a* to 12*d* which are connected to the former.

On the other hand, when the Y-servomotor 62 is rotated in the forward or reverse direction and the servo link 66 is pulled or forced in the direction C or D, the rocking shaft 38 is tilted about the gimbal mechanism 30 in the direction C or D. As a result, the rotor shaft 26 and the base plate 22 are tilted in the direction C or D and the tilting angle of the blades 12*a* to 12*d*, which are connected to the former, is varied in the direction C or D.

Figure 7:
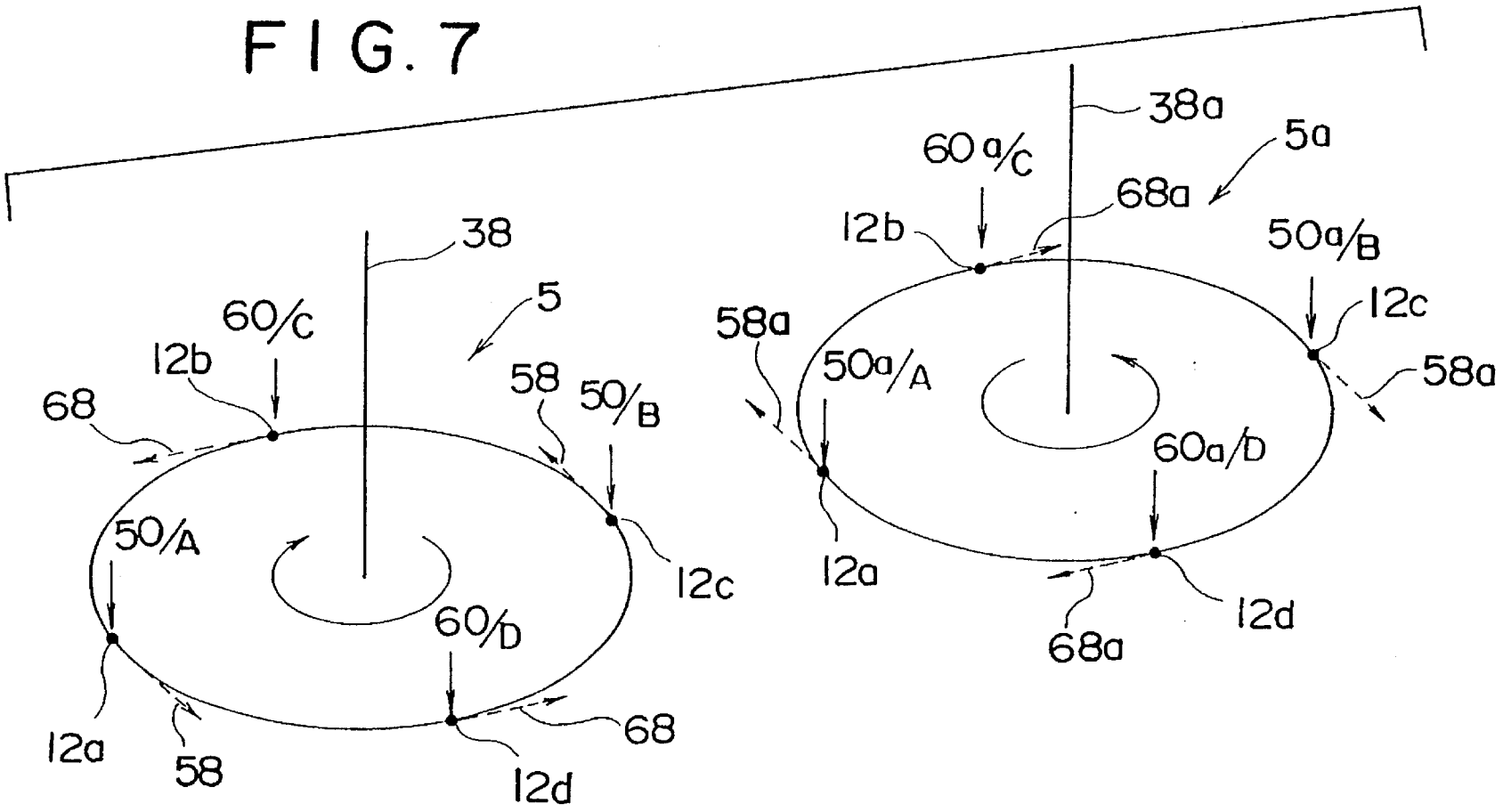
FIG. 7 shows diagrams useful for explaining the points of application acting on the blades due to the tilting of the rotary shafts and the directions of the propulsive forces generated at the points of application.

This operation will be described in greater detail with reference to FIGS. 7, 8*a*–8*d*, and 9*a*–9*g*. In FIG. 7, an arrow 50/A indicates the pressure applied to the work surface by the blade 12*a* when the rocking shaft 38 is tilted in the direction A by the X-servomotor 52, and an arrow 50/B similarly indicates the pressure applied to the work surface by the blade 12*c* when the rocking shaft 38 is tilted in the direction B.

Also, an arrow 60/C indicates the pressure applied to the work surface by the blade 12*b* when the rocking shaft 3 is tilted in the direction C by the Y-servomotor 62, and an arrow 60/D similarly indicates the pressure applied to the work surface by the blade 12*d* when the rocking shaft 38 is tilted in the direction D. It is to be noted that broken arrows 58 and 68 respectively indicate the directions of application of the reactions or the propulsive forces of the machine proper in the above-mentioned cases, and the blade driving mechanism 5*a* performs the similar actions.

Next, the travelling operation of the machine proper 1 will be explained by means of FIGS. 8*a*–8*d* with reference to FIG. 7. Where the rotors 10 and 10*a* are rotated in the opposite directions in the blade driving mechanisms 5 and 5*a*, if the pressures applied to the work surface by the inner blades 12*c* and 12*a* are increased over those of the other blades, the machine proper 1 is moved in the opposite direction to the directions of rotation of the blades 12*c* and 12*a* and hence in the direction of reactions 71 (e.g., toward the front) as shown in FIG. 8*a*.

Figure 8B:
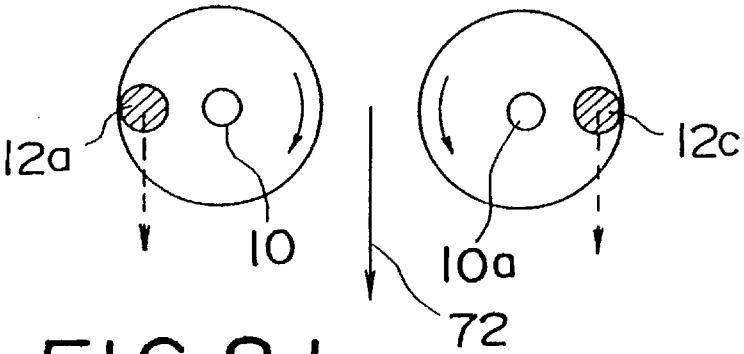
FIGS. 8*a*–8*d* show operational diagrams showing the manners of the straight line motion of the machine proper according to the present invention.

Also, as shown in FIG. 8*b*, if the pressures applied to the work surface by the outer blades 12*a* and 12*c* are increased over those of the other blades, due to the resulting reactions, the machine proper 1 is moved in the opposite direction 72 to the rotational directions of the blades 12*a* and 12*c* which are increased in pressure (e.g., toward the rear).

Figure 8D:
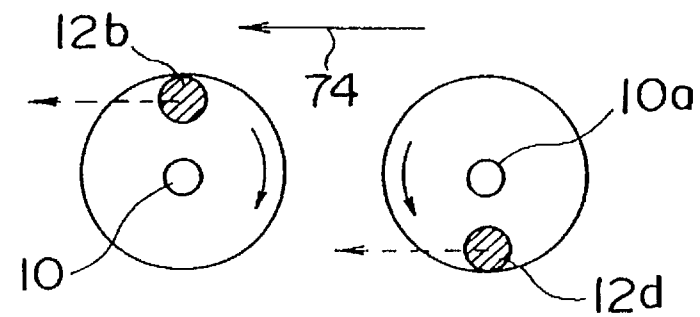
Figure 8A:
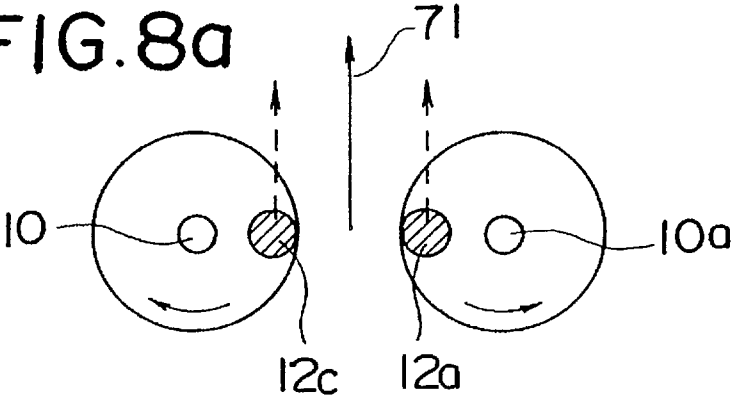
Figure 8C:
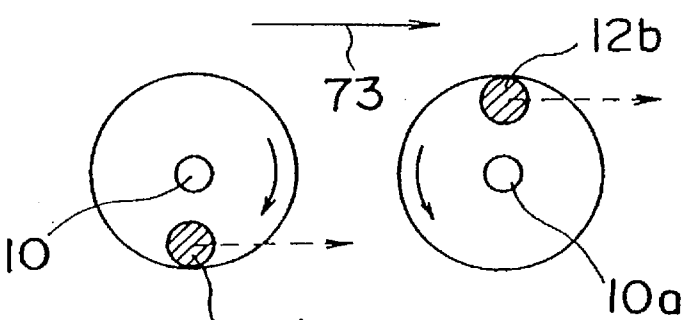

Further, as shown in FIG. 8*c*, if the pressures applied to the work surface by the blade 12*d* on the rotor 10 side and the blade 12*b* on the rotor 10*a* side and opposite to the blade 12*d* are increased over the other blades, the resulting reactions cause the machine proper 1 to move in the right directions 73, whereas, as shown in FIG. 8*d*, if the pressures applied to the work surface by the blade 12*b* on the rotor 10 side and the blade 12*a* in the rotor 10*a* side and opposite to the blade 12*b* are increased, the resulting reactions causes the machine proper 1 to move to the left direction 74.

Figure 9A:
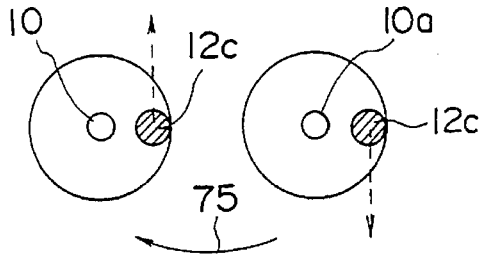
FIGS. 9*a*–9*g* similarly show operational diagrams showing the manners of the turning motion of the machine proper.
Figure 9B:
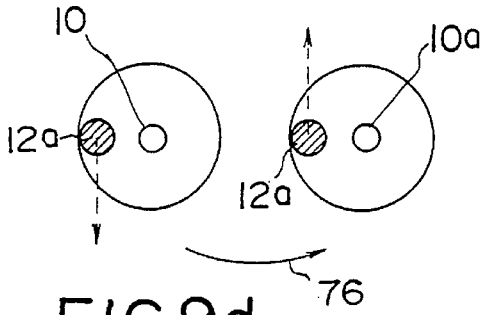
Figure 9C:
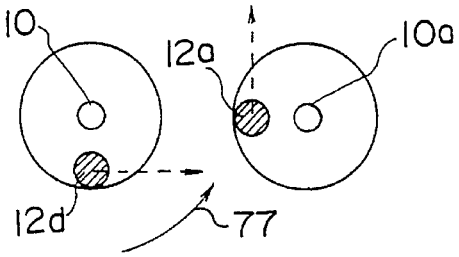
Figure 9D:
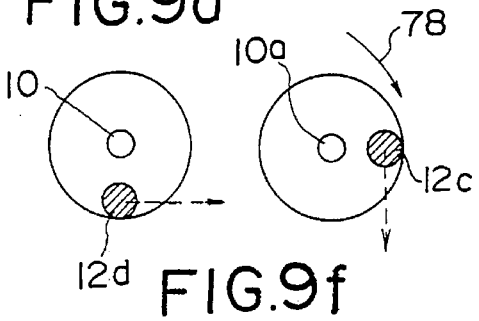
Figure 9E:
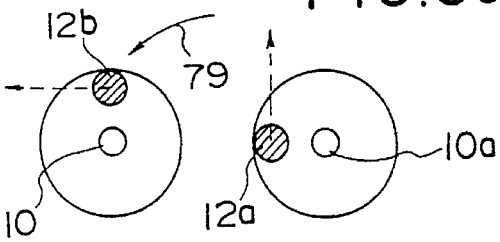
Figure 9F:
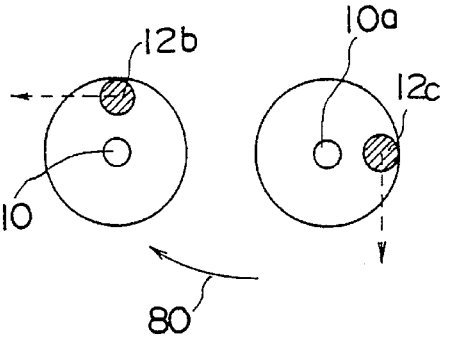
Figure 9G:
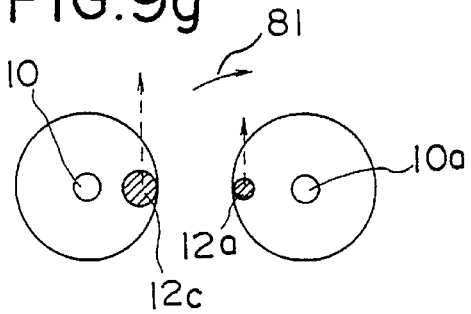

On the other hand, as shown in FIG. 9*a*, if the pressures applied to the work surface by the inner blade 12*c* on the rotor 10 side and the outer blade 12*c* on the rotor 10*a* side are increased, the resulting reactions cause the machine proper 1 to turn in the clockwise direction 75, whereas, as shown in FIG. 9*b*, if the pressures applied to the work surface by the outer blade 12*a* on the rotor 10 side and the inner blade 12*a* on the rotor 10*a* side are increased, the machine proper 1 is caused to turn in the counterclockwise direction 76 due to the resulting reactions. It is to be noted that as shown in FIGS. 9*c* to 9*g* by way of examples, by suitably selecting the blades 12*a* to 12*d* of the rotors 10 and 10*a* which will be increased in pressure applied to the work surface, it is possible to perform various applied operations. In this case, the machine proper 1 is turned in such directions as indicated by arrows 77 to 81.

Next, the method of improving the controllability of the travelling operation and turning operation of the machine proper according to the invention will be described.

In accordance with the present invention, as shown in FIGS. 1 and 2, the blades 12*a* to 12*d* are each provided with 20 degrees of freedom of rocking movement by the rocking supporting unit 14 composed of the bearing 18 mounted on the fitting member 13 and the supporting pin 17 for pivotally connecting the holding member 16 and the bearing 18.

Here, as will be seen from the description made in connection with FIGS. 8*a*–8*d* and 9*a*–9*g*, the travelling direction and turning direction of the machine proper are dependent on the radial positions (the point of pressure application positions) of the two sets of blades which are increased in pressure applied to the concrete floor due to the tilting of the right and left rotary shafts 28 and 28*a*.

Figure 10:
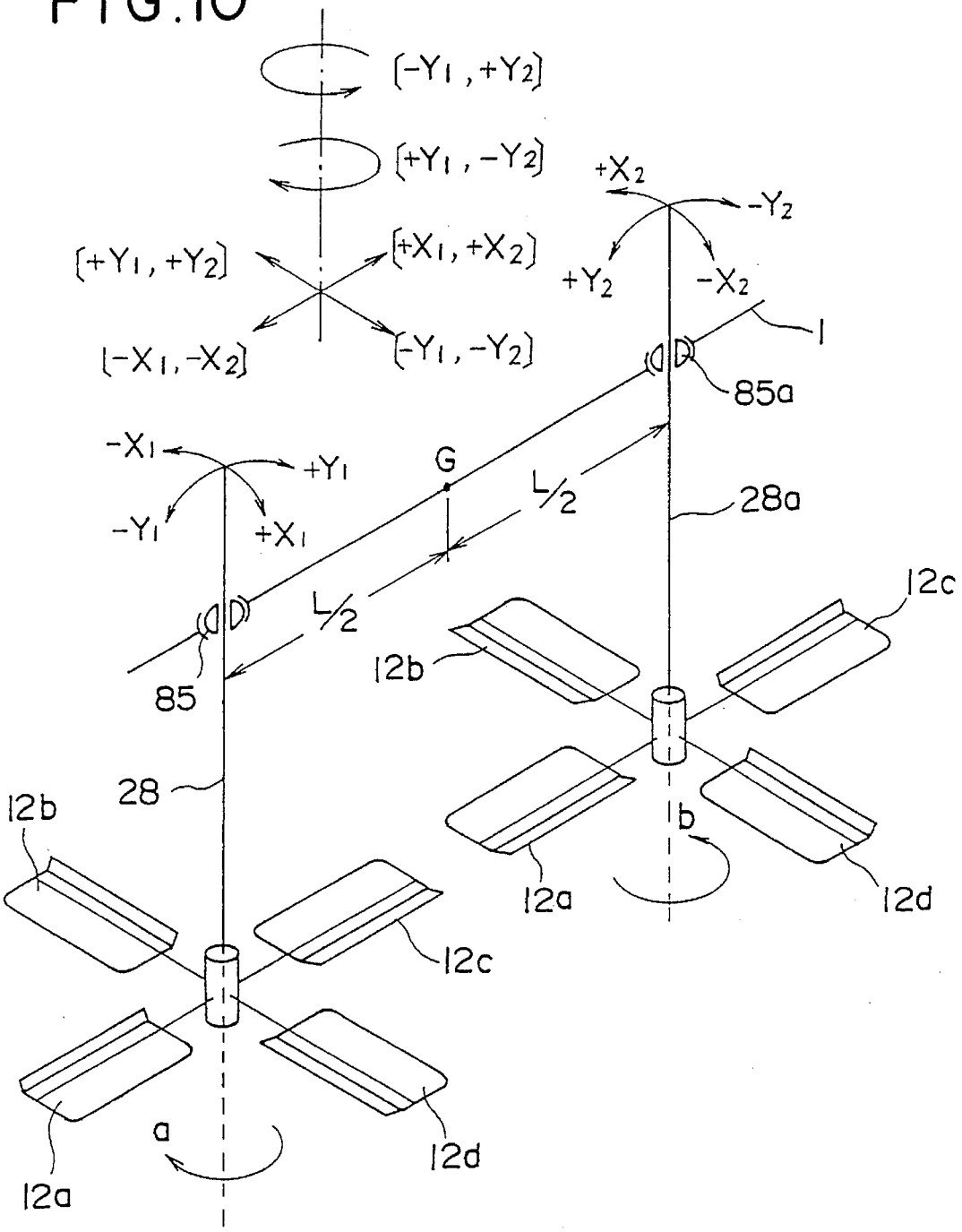
FIG. 10 shows operational diagrams showing generally the principle of movement of the machine proper.

Now describing with reference to FIG. 10, numeral 1 designates the machine frame and the right and left rotary shafts 28 and 28*a* are symmetrically arranged at the distance of L/2 from the machine centroid position G. Numerals 85 and 85*a* designate spherical bearings respectively forming the supporting portions of the tiltable rotary shafts 28 and 28*a* (in fact, the gimbal mechanisms 30 and 30*a* of the rocking shafts 38 and 38*a* as shown in FIG. 1, for example). Also, the rotational directions of the rotary shafts 28 and 28*a* are opposite to each other. With this construction, if, for example, the pressure of the blade 12*d* is increased by the tilting in $+X_1$ of the rotary shaft 28 and simultaneously the pressure of the blade 12*b* is increased by the tilting in $+X_2$ of the rotary shaft 28*a*, the both blades are subjected to the reactions of +X and the machine proper is moved in the direction of +X. The turning operation is also similar so that as for example, the machine proper is turned counter clockwise in response to the tilting in $-Y_1$ and $+Y_2$ of the rotary shafts 28 and 28*a*, respectively. It is to be noted that generally the tilt angles of the rotary shafts 28 and 28*a* are selected to be 2° at maximum in all directions.

Figures 25A, 25B, 25C, 25D:
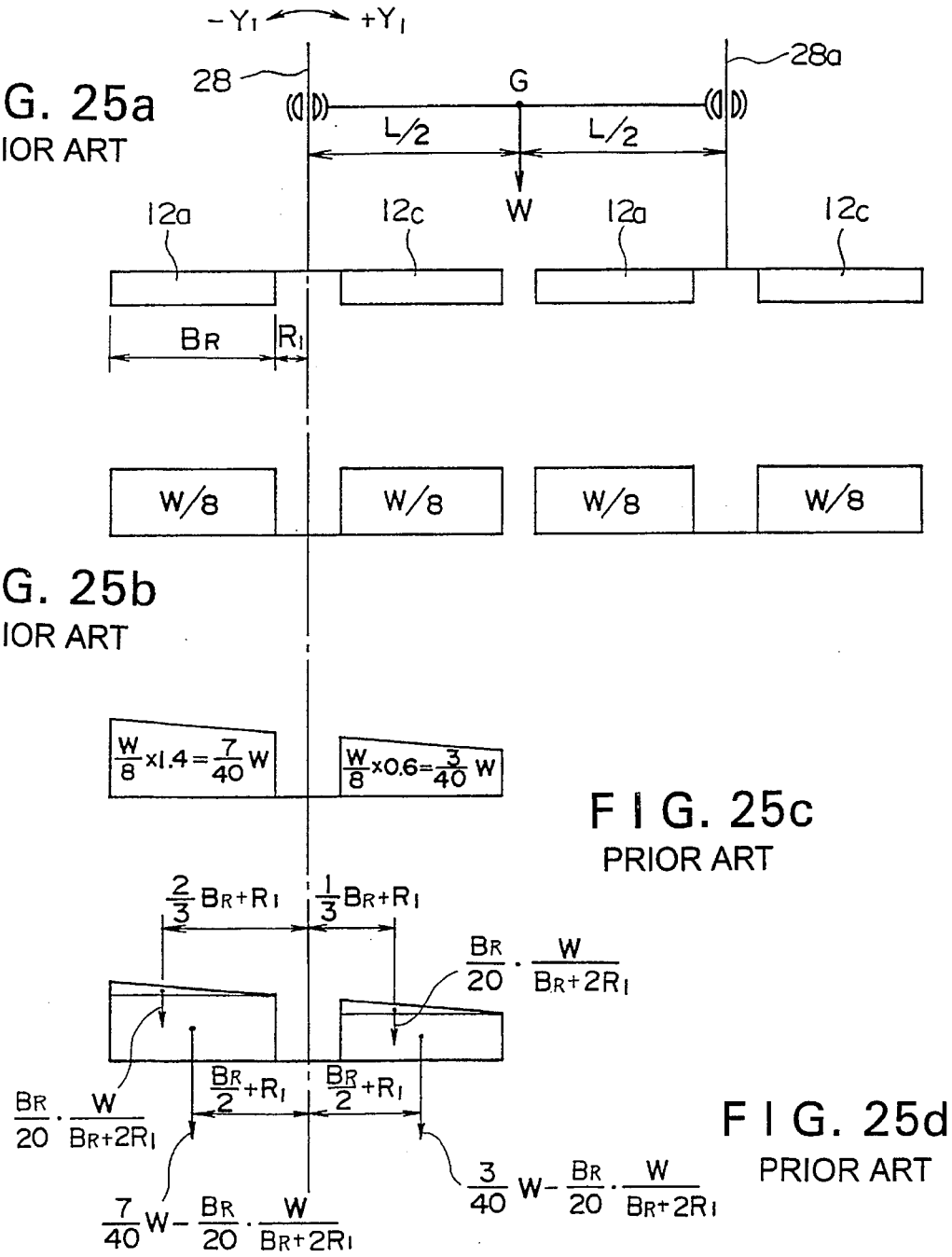
FIG. 25a PRIOR ART
FIG. 25b PRIOR ART
FIG. 25c PRIOR ART
FIG. 25d PRIOR ART
FIGS. 25*a*–25*d* show load distribution diagrams of prior art for the blades in a conventional apparatus.

Next, the distribution of loads which act on the blades will be explained by way of a comparison between the present invention (FIG. 11) and a prior art (FIG. 25). In FIG. 25, (a) shows the arrangement of rotary shafts 28 and 28*a* and their blades 12*a* and 12*c* in the conventional machine. Symbol W designates the machine weight concentrated at the machine centroid position G, $B_R$ the radial width of the blade, and $R_1$ the radius of rotation of the blade inner end.

In FIG. 25, when the tilts of the rotary shafts 28 and 28*a* are 0°, each of the blades has a load distribution of W/8 as shown by (b).

Assuming now that the rotary shaft 28 is tilted in the direction of $-Y_1$ so that as for example, the blade 12*a* shares a load of W/8×1.4 and the blade 12*c* shares a load of W/8×0.6, there result the load distributions as shown in by (c).

(d) shows the load centroid positions and the load values of the two blades. The difference between the products of the load centroid positions and the load values shows the increased pressure value for moving the machine proper and its point of application.

The load difference of the blades (i.e., the increased pressure value) is given by W/8×1.4−W/8×0.6=W/10 and its point of application is as shown by the following equation (1).

[increased pressure value] × [point of application] = (1)

$$\left[\frac{W}{10}\right]\times\left[\frac{B_R}{2}+R_1)+\frac{B_R^2}{6}\cdot\frac{1}{B_R+2R_1}\right]$$

Figure 11:
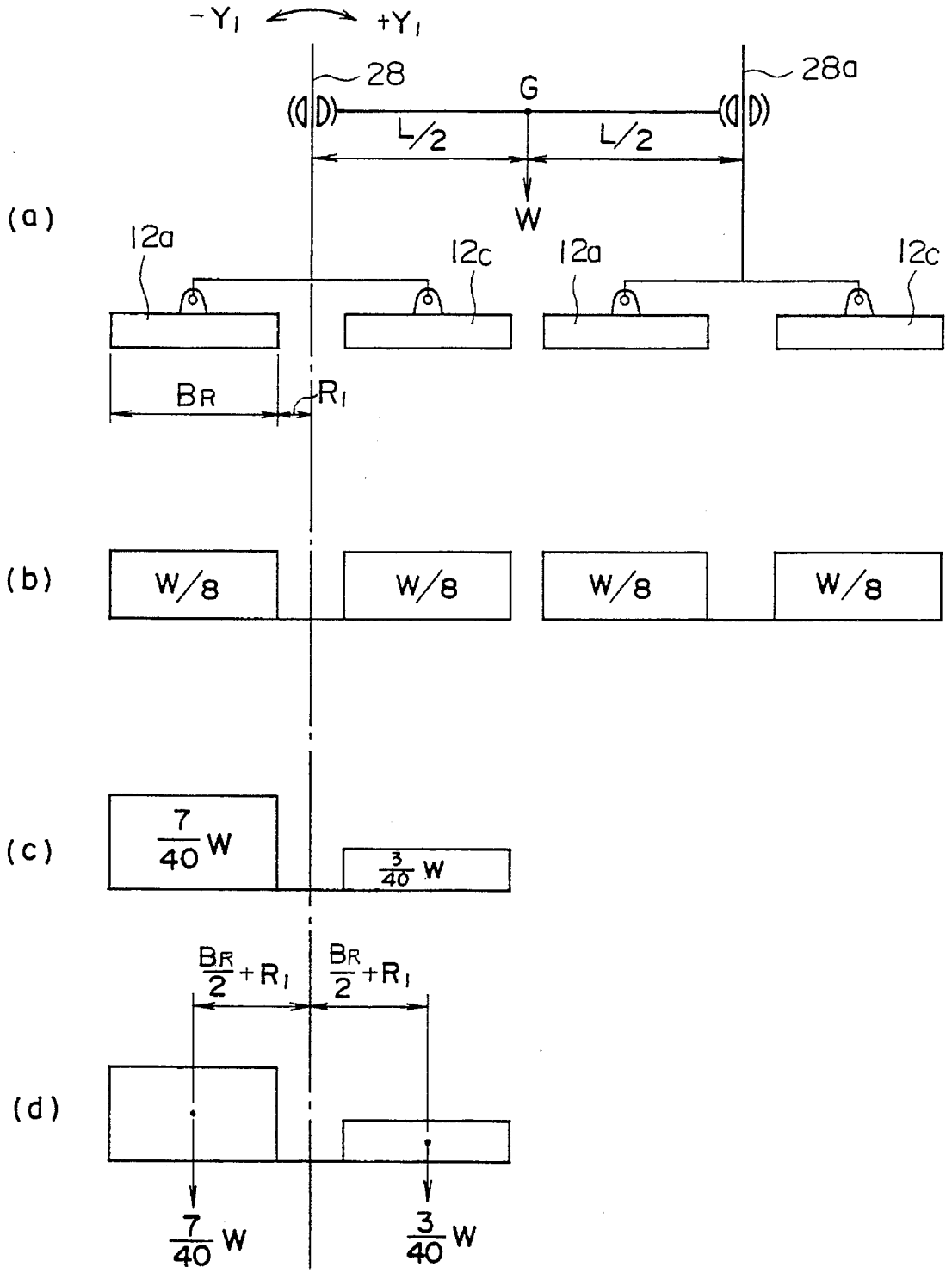
FIG. 11 shows the load distribution diagrams of the blades according to the invention.

FIG. 11 shows the load distributions according to the present invention. (a) shows the arrangement of the rotary shafts 28 and 28*a* and the blades 12*a* and 12*c*.

The 20° freedom of rocking movement is ensured for each blade by the rocking supporting unit 14. Note that symbols W, $B_R$ and $R_1$ are the same as in the case of FIG. 25.

Where the tilts of the rotary shafts 28 and 28*a* are 0°, all the blades have the same load distribution of W/8 as shown by (b).

Assuming now that the rotary shaft 28 is tilted in the direction of $-Y_1$ so that as for example, the blade 12*a* a shares a load of W/8×1.4 and the blade 12*c* shares a load of W/8×0.6 as in the conventional case, due to the 20 degrees of freedom of rocking movement ensured for each blade, the load distribution of each blade becomes a uniform distribution as shown by (c).

At this time, the load centroid positions and the load values of the two blades become as shown by (d). and the difference between the products of the load centroid positions and the load values indicates an increased pressure value for moving the machine proper and its point of application.

The load difference (the increased pressure value) between the blades is W/10 and its point of application is given by the following equation (2).

[increased pressure value] × [point of application] = (2)

$$\left[\frac{W}{10}\right]\times\left[\frac{B_R}{2}+R_1\right]$$

From the above equation (1) and (2) it will be seen that the 20° freedom of rocking movement moves the point of application of the increased pressure value toward the center of rotation.

While the tilting of the rotary shaft 28 in the $-Y_1$ direction has been explained with reference to FIGS. 25 and 11, the same applies not only to its tilting in the $+Y_1$ and $\pm X_1$ directions but also to the tilting of the rotary shaft 28*a* in the $+Y_2$ and $+X_2$ directions.

As regards the travelling operability and controllability of the machine proper, of the attitudes of the machine proper the heading controllability (turning controllability) for controlling the direction of the machine proper is the most important point and thus the machine proper excellent in heading controllability is also excellent in operability and controllability.

Figure 12A:
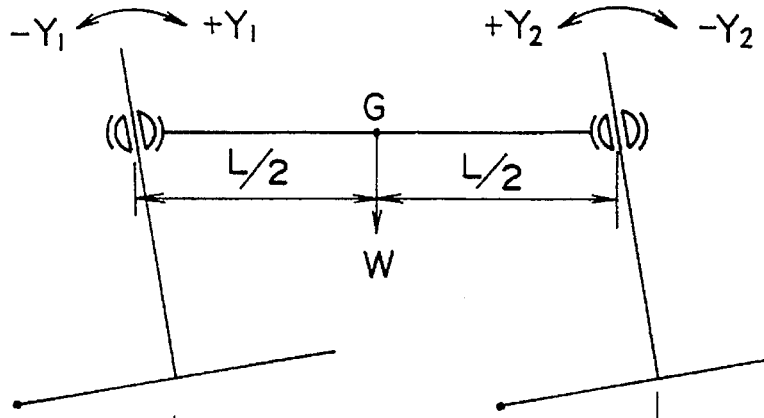
FIGS. 12*a*–12*d* show diagrams of the loads acting on the blades during the turning of the machine proper.
Figure 12B:
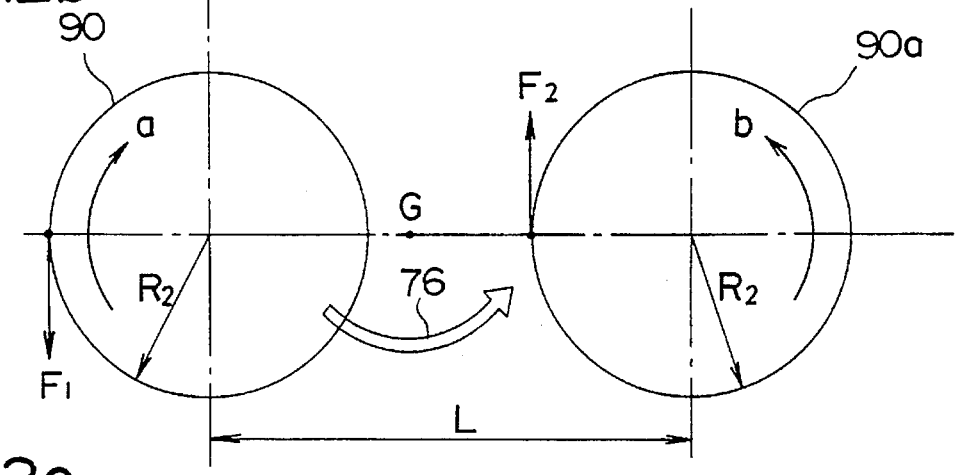

The heading controllability can be evaluated in terms of the turning performance in a given position. Now assume that in FIG. 12*a* the rotary shafts 28 and 28*a* are respectively tilted in the $-Y_1$ and $+Y_2$ directions to turn in the counterclockwise direction. At this time, the blades respectively form application point rotational circles 90 and 90*a* of radius $R_2$ as shown in FIG. 12*b*.

Figure 12C:
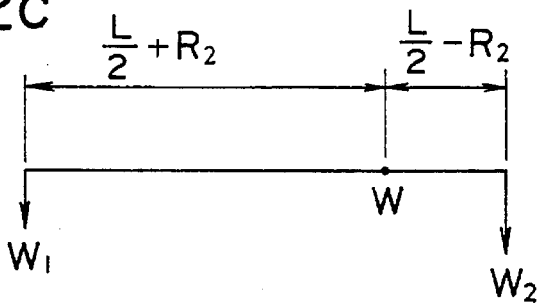

Assuming that the machine weight W is born by the point of application rotational circle, $W_1$ and $W_2$, shown in FIG. 12*c*, can be determined by the following equations (3), (4) and (5), respectively.

$$W_1+W_2=W \tag{3}$$

$$W_1=\frac{L/2-R_2}{L}\cdot W \tag{4}$$

$$W_2=\frac{L/2+R_2}{L}\cdot W \tag{5}$$

Assuming now the friction coefficient K of the blades on freshly mixed concrete (K is a coefficient proportional to the peripheral velocity), the reactions $F_1$ and $F_2$ from the concrete floor surface can be given by the following equations (6) and (7).

$$F_1=KW_1 \tag{6}$$

$$F_2=KW_2 \tag{7}$$

Figure 12D:
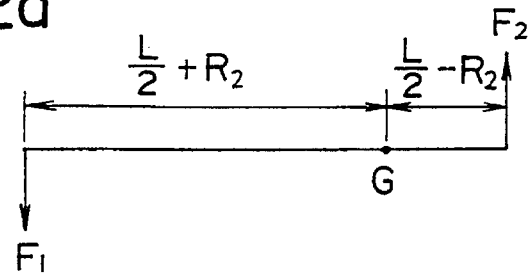

As shown in FIG. 12*d*, the torques the $T_1$ and $T_2$ caused about machine centroid by the reactions $F_1$; and $F_2$ can be given by the following equations (8) and (9):

$$T_1=F_1\times\left(\frac{L}{2}+R_2\right)=\frac{KW}{L}\left(\frac{L^2}{4}-R_2^2\right) \tag{8}$$

$$T_2=F_2\times\left(\frac{L}{2}+R_2\right)=\frac{KW}{L}\left(\frac{L^2}{4}-R_2^2\right) \tag{9}$$

In equation (10), the sum of $T_1$ and $T_2$ represents a turning force. In this equation K is the constant proportional to the peripheral velocity and therefore the turning force can be determined by the effect expression given by the following equation (11). This equation (11) is the performance index representing the turning performance of the machine proper $$T_1+T_2=\frac{2KW}{L}\left(\frac{L^2}{4}-R_2^2\right) \tag{10}$$

$$J=R_2\left(\frac{L^2}{4}-R_2^2\right) \tag{11}$$

Figure 13:
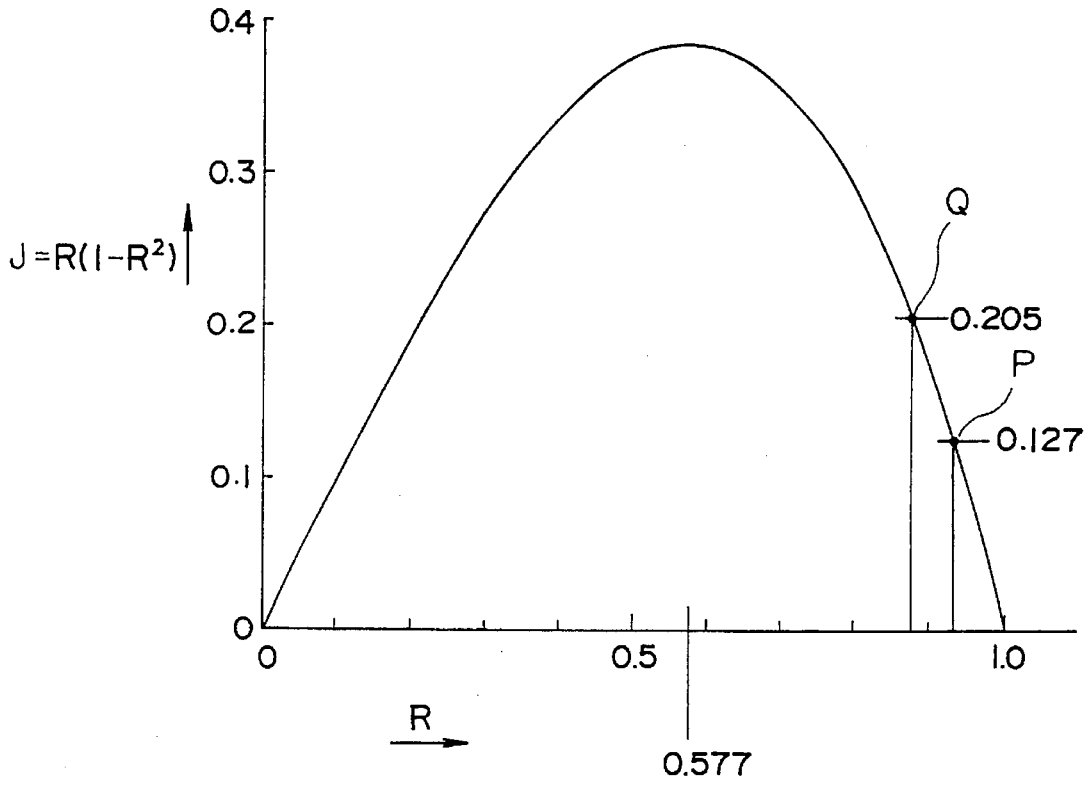
FIG. 13 is a torque of turning characteristic diagram indicating the turning performance of the machine proper.

Here, by selecting L=2 and taking the dimensionless $R_2$ as R in the range of 0 to 1, equation (11) can be rewritten into equation (12). FIG. 13 is a graph obtained by plotting the performance index equation (12) of the turning force against the values of R=0–1.

$$J=R(1-R^2) \tag{12}$$

In FIG. 13. the point of application radius=0 indicates that the turning force=0, whereas R=1 results in $R_2$=L/2 so that the point of application passes just below the machine centroid and similarly no turning force is produced. Then, the maximum turning force is produced when R=0.577.

Let us design a machine of R=0.577 which produces such maximum turning force. With $R_1$=100 mm and $B_R$=150 mm, the point of application radius $R_2$ is obtained from equation (13) and also the center distance L is obtained from equation (14) for the conventional machine, as follows:

Point of application radius $R_2$=185.7 mm.

Figure 15:
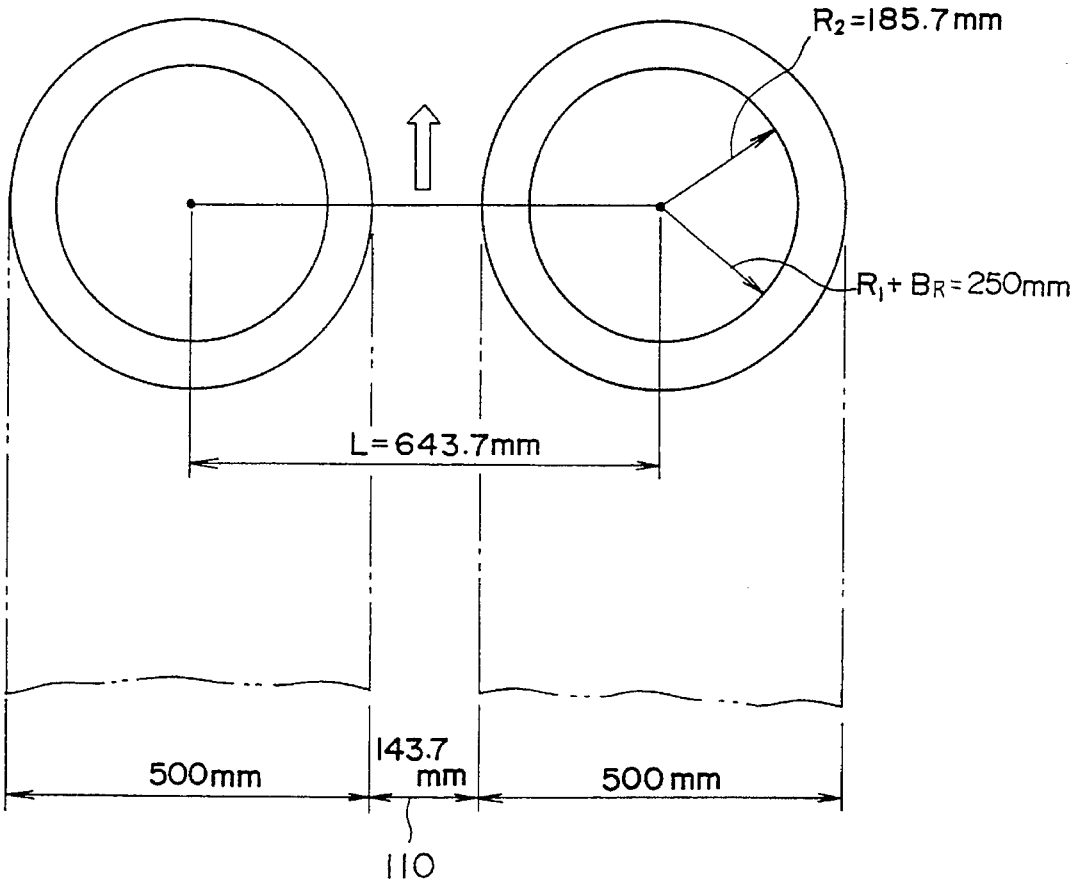
FIG. 15 is a diagram showing an exemplary dimensional arrangement of the blades when the turning performance of the machine proper is made maximum.

Center distance L=643.7 mm and these are shown in FIG. 15.

From equation (1) we obtain $$\text{Point of application radius } R_2=\left(\frac{B_R}{2}+R_1\right)+ \tag{13}$$

-continued $$\frac{B_R^2}{6} \cdot \frac{1}{B_R + 2R_1}$$

$$\frac{R_2}{L/2} = 0.577 \quad (14)$$

Figure 17:
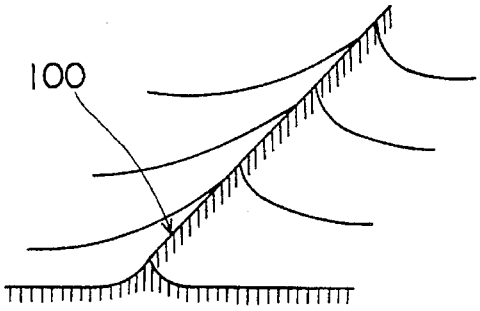
FIG. 17 is a diagram showing the manner in which a projection is caused in the central part of the finished surface in the case of FIG. 16*b*.
Figure 16A:
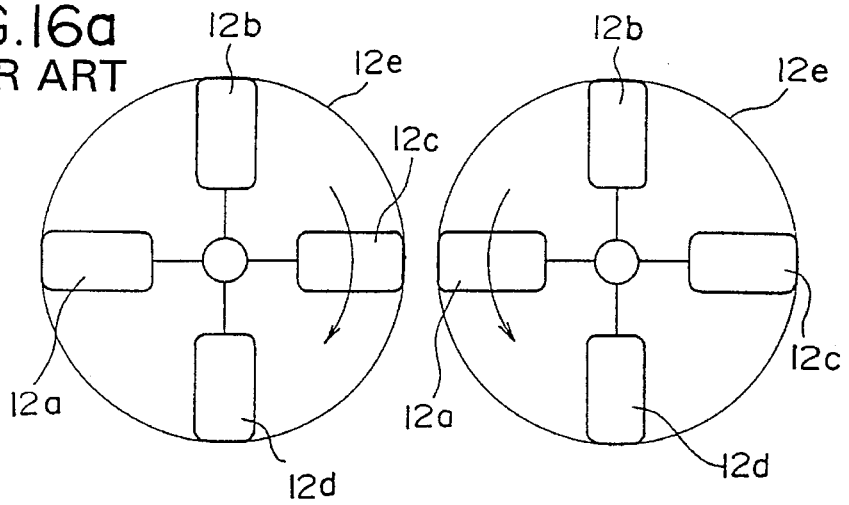
FIG.16a PRIOR ART
FIGS. 16*a*–16*d* illustrate diagrams of prior art showing exemplary arrangements of the blades.
Figure 16B:
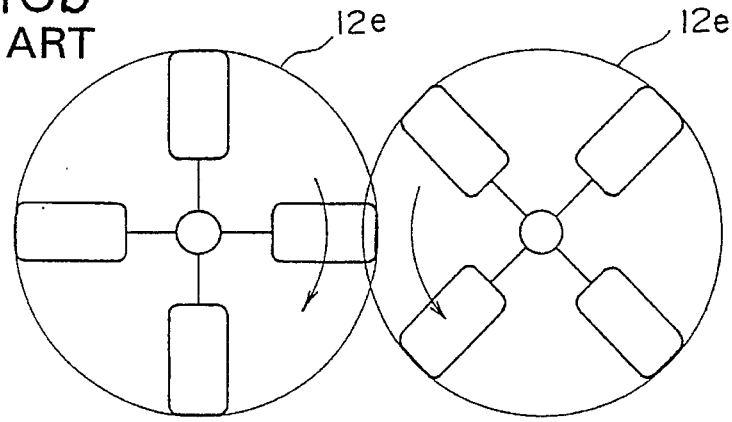
FIG.16b PRIOR ART
Figure 16D:
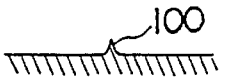
FIG.16d PRIOR ART
Figure 16C:
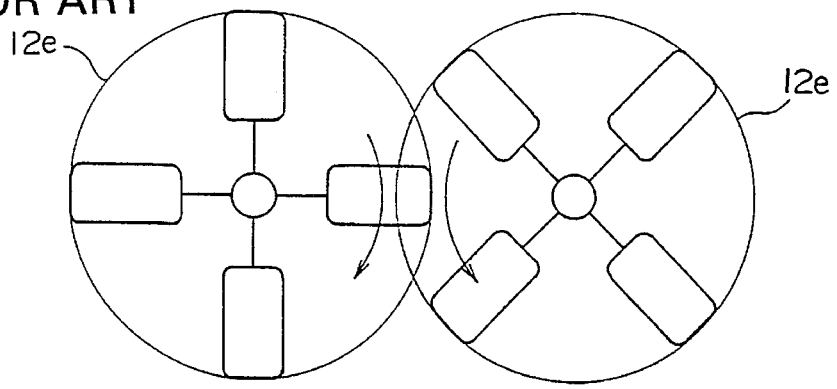
FIG.16c PRIOR ART

Although the construction of FIG. 15 results in the machine design which ensures the maximum turning force, the areas finished by the two or right and left sets of blades do not overlap each other and therefor there results an unfinished area 110 of 143.7 mm wide, thus making the machine inadequate as the floor finishing machine.

Where the amount of overlapping is small, a stripe-like projection 100 is caused, in the central portion of the finished surface by the blades on the right and left sides as shown in FIG. 17 and no excellent finished surface is obtained.

Figure 14:
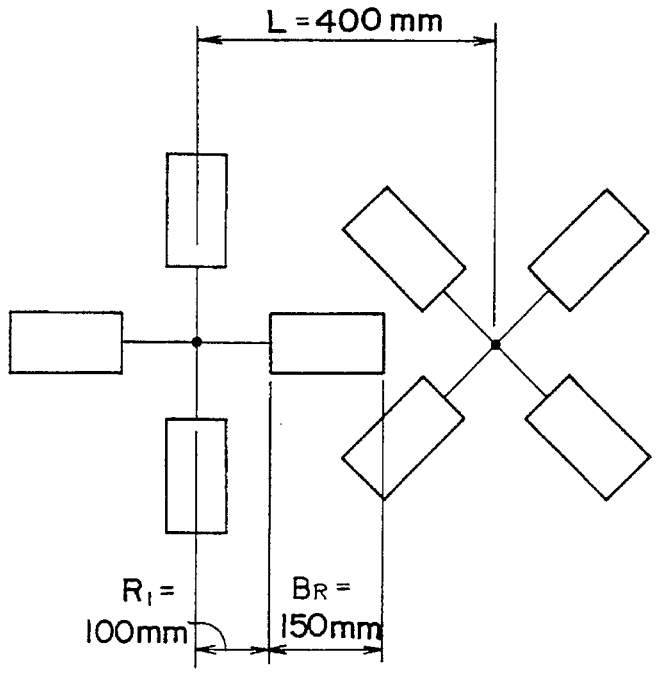
FIG. 14 is a diagram showing an exemplary dimensional arrangment of the blades according to the invention.

Referring to FIG. 14, there are shown exemplary machine dimensions that ensures a sufficient amount of overlapping for the floor finishing machine to produce an excellent finished surface.

With the construction of FIG. 14, let us examine the difference in turning force due to the difference between the blade supporting methods of the conventional machine and the present invention. Assuming the the rotary shaft center distance L=400 mm, $R_1$=100 mm and $B_R$=150 mm, the point of application radius $R_2$ is obtained from equations (1) and (2) and also the values of R are obtained Prior art R=0.929

Invention R=0.875

By substituting these values into equation (12), we obtain as follows:

Prior art J=0.127 (the point P in FIG. 13)

Invention J=0.205 (the point Q in FIG. 13)

Thus, it will be seen that the turning performance is considerably improved.

Embodiment 2

Figure 18:
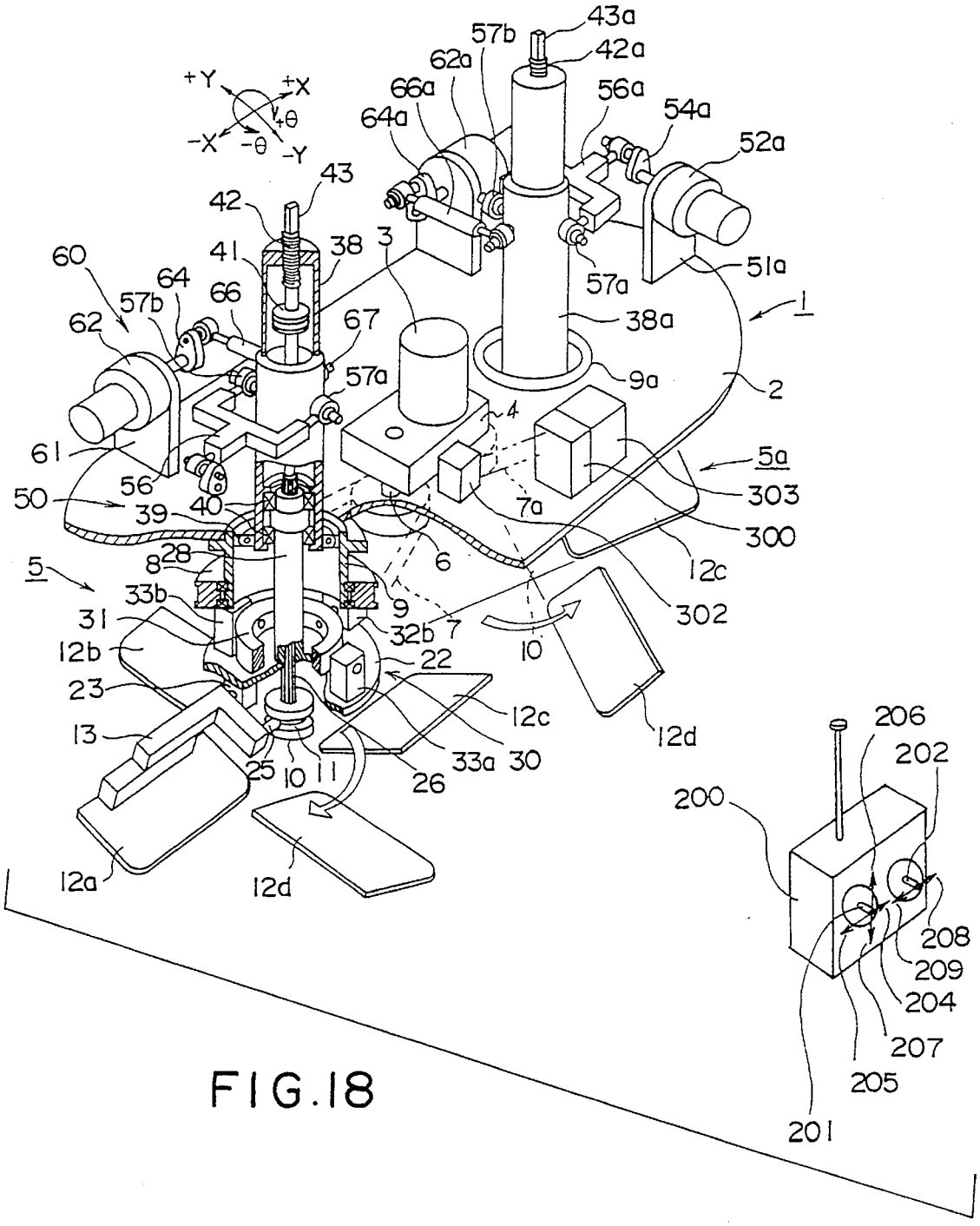
FIG. 18 is a schematic perspective view showing partly in section a second embodiment of the present invention.

Referring now to FIG. 18, there is illustrated the second embodiment of the present invention. While, in this embodiment, each of the blades 12*a* to 12*d* is attached to the fitting member 13, it is possible to arrange so that each of the blades is rockably supported by the rocking supporting unit 14 as described in connection with the first embodiment.

The second embodiment further includes a receiver 300 for receiving a command signal from a transmitter 200 by remote operation, a heading detector 302 for detecting the heading of the machine proper 1, and a control unit 303 responsive to the signal detected by the heading detector 302 to correct the amount of heading deviation and thereby to output a control signal to each of the servomotors 52, 62, 52*a* and 62*a* of the X- and Y-rocking mechanisms and these units are mounted on the machine proper 1.

Figure 19:
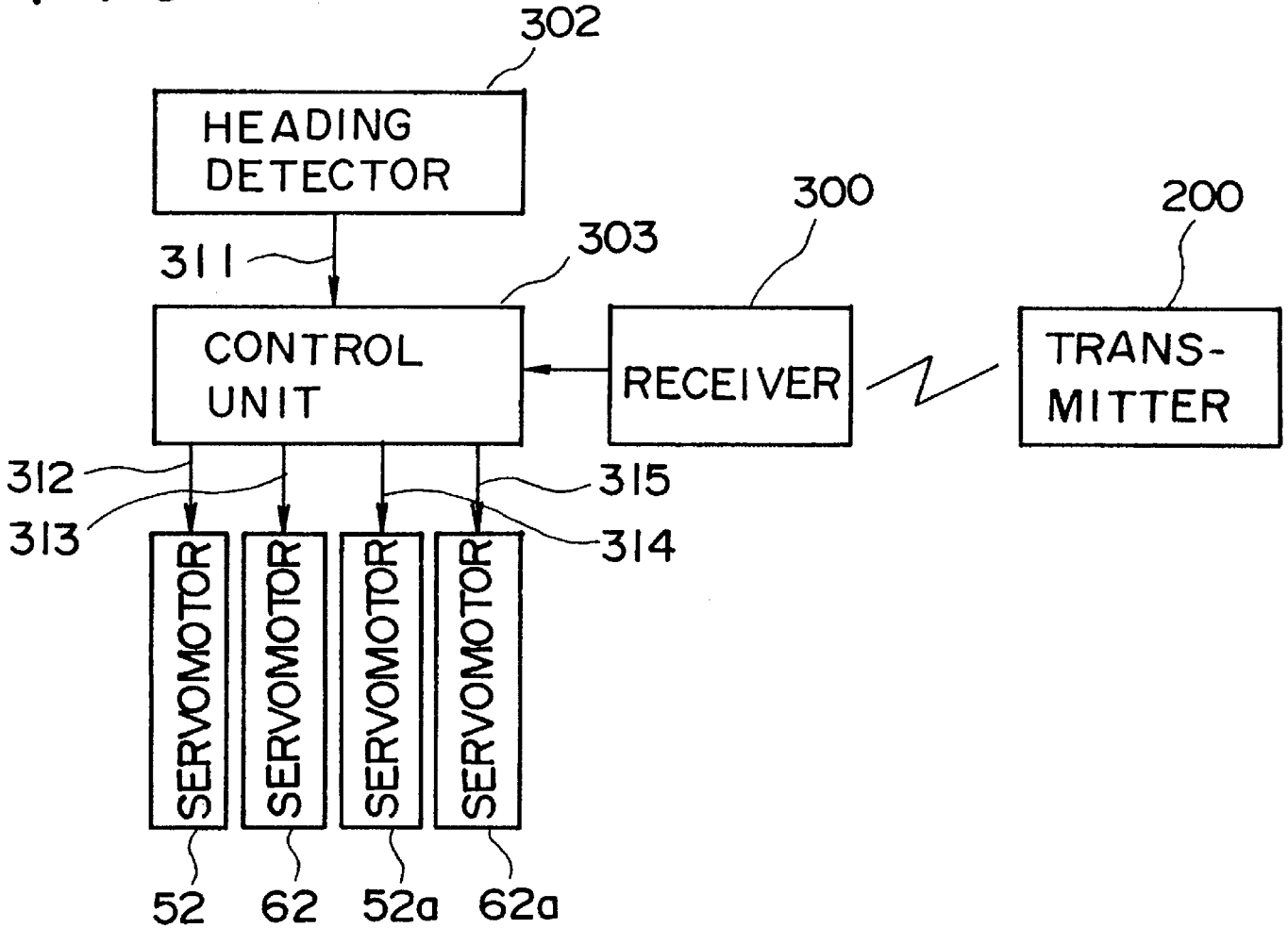
FIG. 19 is a block diagram showing an embodiment of the control system according to the present invention.
Figure 20:
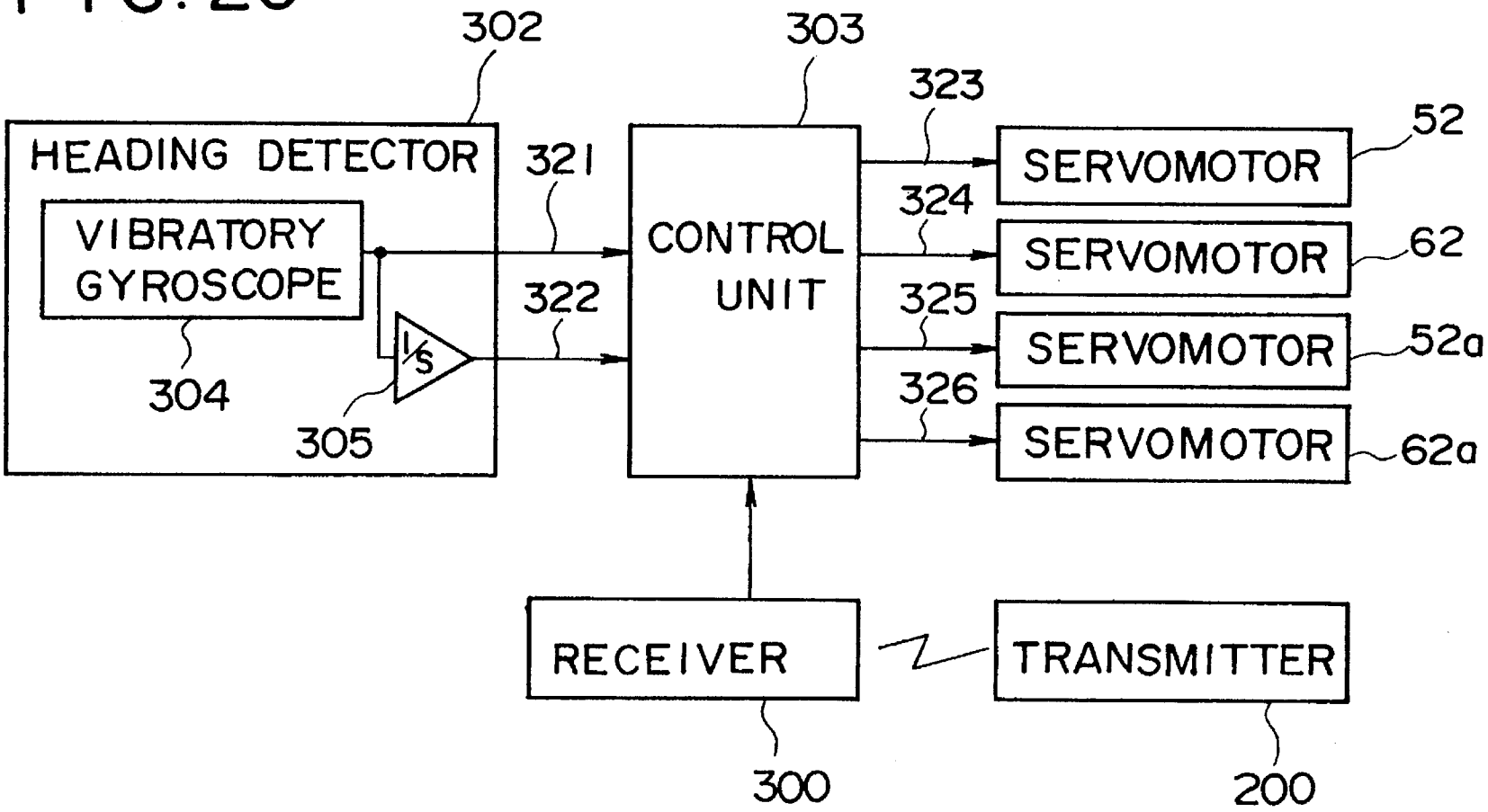
FIG. 20 is a block diagram showing another embodiment of the control system according to the present invention.

The heading detector 302 is a known type of a north seeking or compass gyroscope, a magnetic heading sensor, an angular sensor combining a vibratory gyro and an integrator or an optical fiber gyroscope. The transmitter 200 includes a first stick 201 for imparting the +X-movements (arrow 204 and 205) and +Y-movements (arrows 206 and 207) to the machine proper 1 and a second stick 202 for imparting +θ turning movements (arrows 208 and 209) to the machine proper 1. FIGS. 19 and 20 are block diagrams showing the construction of the control system of the present invention.

FIG. 19 shows the heading detector 302 composed of a compass gyroscope, a magnetic heading sensor or an optical fiber gyroscope.

The heading detector 302 detects a machines turning angle from a predetermined heading to apply the resulting angle signal 311 to the control unit 303. The control unit 303 controls the tilting servomotors 52, 62, (52*a*) and 62*a* of the rotary shafts 28 and 28*a* by means of corrected tilt angle signals 3/2 to 3/5 thus correcting the turning angle and thereby maintaining constant the heading of the machine proper 1.

FIG. 20 shows the heading detector 302 composed of a vibratory gyro 304 and an integrating circuit 305.

The vibratory gyro 304 detects a machine turning angular velocity and applies its angular velocity signal 321 to the control unit 303. The detected angular velocity signal 321 is also sent as a machine turning angle signal 322 to the control unit 303 through the integrating circuit 305. In response to these signals 321 and 322 the control unit 305 controls the tilting servomotors 52, 62, 52*a* and 62*a* of the rotary shafts 28 and 28*a* by means of corrected tilt angle signals 323 to 326, respectively. The angular velocity signal 321 is effective in damping the turning sliding motion of the machine proper 1 and the heading control of the machine proper 1 is considerably stabilized as compared with the case in which only the angle signal is supplied to the control unit as in FIG. 19.

Then, the use of the vibratory gyro gives rise to a drift problem. In other words, while the drift varies due to the time, ambient temperature, etc., inherent to an individual vibratory gyro and thus it is impossible to obtain an accurate angular velocity unless the magnitude of the drift of the vibratory gyro is preliminarily known during its use, in accordance with the present invention the following system is adopted to reduce the occurrence of measurement errors in the measurement of the drift 5.

(1) When the clutch of the engine mounted on a machine proper is disengaged, it is basically considered that the machine proper is at rest and the drift is measured only in such case.

(2) While obtaining the moving average of the output of the vibratory gyro during the measurement of the drift, the standard deviation of the drift value is separately calculated, so that it is not adopted as a new drift value unless a standard deviation of less than a given value is attained.

With the concrete-floor finisher of the type according to the present invention, it is extrmely difficult to completely stop the machine proper for several seconds and therefore the drift is measured and calibrated by a system such as described above thereby preventing the accumulation of measurement errors.

Next, the operation of the present embodiment will be described. In order to cause the machine kproper 1 to make ±X movements, ±Y movements and ±θ turning, ±X and ±Y movement commands are suplied by the first stick 201 of the transmitter 200 and +θ turning commnads are also supplied by the second stick 202.

As the result of these stick operations, the machine proper 1 can be caused to make various motions such as shown in FIGS. 8*a*–8*d* and 9*a*–9*g*. On the concrete floor surface, however, even if, for example, the machine proper is moved forward by a +Y travel command from the first stick 201, due to such circumstances as the drying condition of the concrete, the surface irregularities, the friction coefficient, etc., the machine proper is accompanied with a +X or −X side sliding movement or a +θ or −θ sliding movement and thus the remote operation with the desired direction and attitude cannot be performed.

In the case of the convention machine, when moving the machine proper forward, it has been the practice to operate the machine proper so that while moving the machine proper forward by a ±Y travel command by the first stick 201, a side sliding correction amount +X or −X is applied and also a turning sliding correction amount +θ or −θ is applied by the second stick 202, and it is extremely difficult to perform the correction operation by these stick operations alone.

Thus, it is designed so that as shown in FIG. 18, the heading detector 302 for detecting the heading of the machine proper 1 during the travelling is disposed on the supporting plate 2 thereby performing an automatic control so as to always maintain the given heading.

Figure 21A:
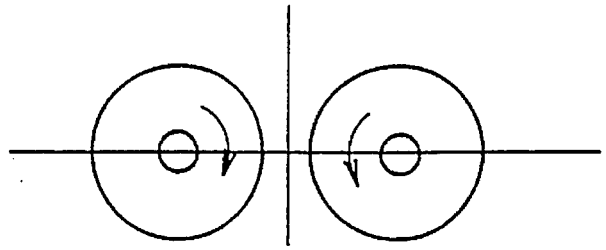
FIGS. 21*a*–21*d* are diagrams for explaining the turning correcting operation by the plurality of rotary shafts in the second embodiment.
Figure 21B:
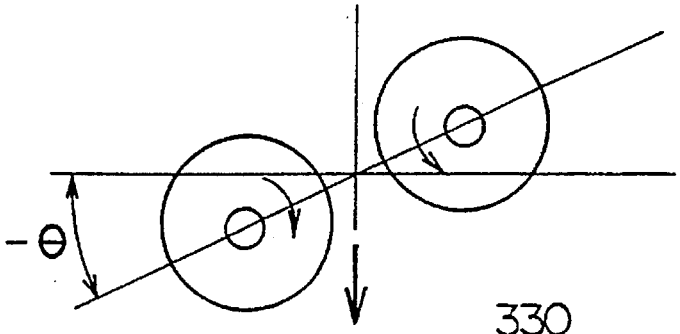
Figure 21C:
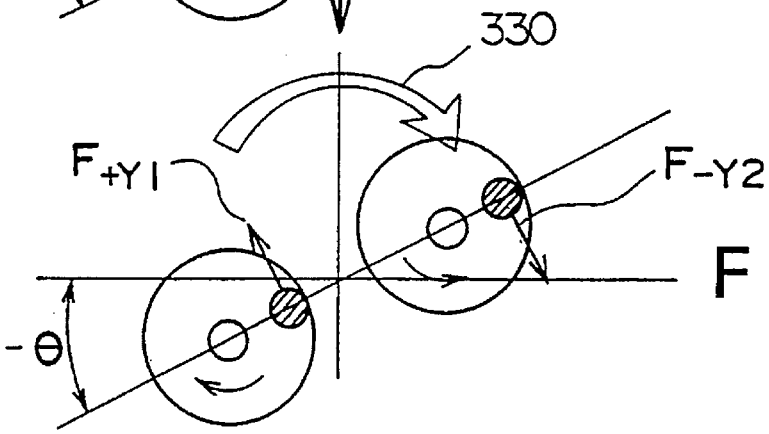
Figure 21D:
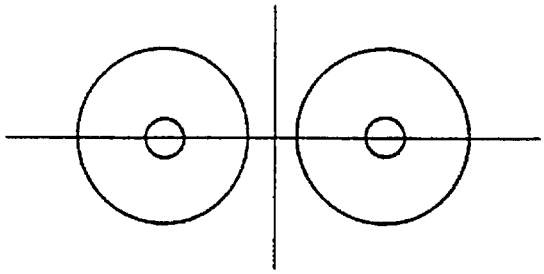
Figure 22A:
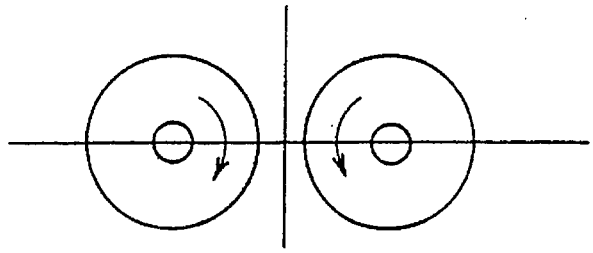
FIGS. 22*a*–22*d* are diagrams for explaining the turning correcting operation by one of the rotary shafts in the second embodiment.
Figure 22B:
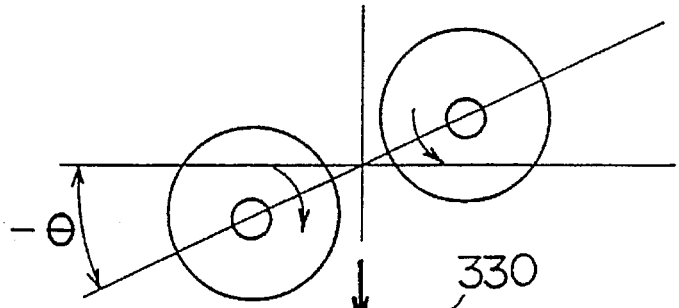
Figure 22C:
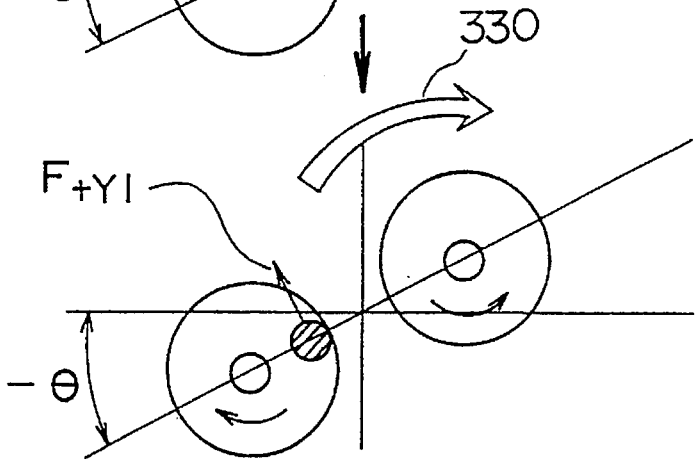
Figure 22D:
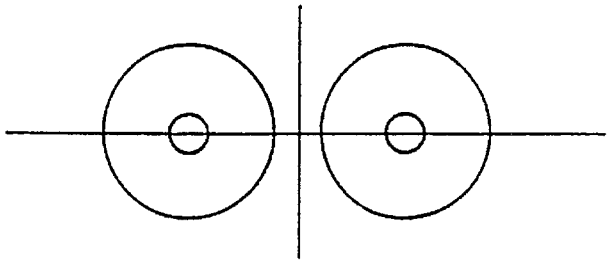

Now the turning correction operation by the rotary shafts 28 and 28*a* is explained with reference to FIGS. 10 and 21*a*–21*d*. In FIG. 21*b*, if, for example, a −θ direction turning sliding motion is caused from in the hovering condition in FIG. 21*a*, the control unit 303 calculates a sliding angle in accordance with the detection signal from the heading detector 302 and it also tilts the rotary shaft 28 in the $+Y_1$ direction and the rotary shaft 28*a* in the $-Y_2$ direction, thus performing a turning correction operation to a +θ direction 330 as shown in FIG. 21*c* and thereby maintaining the heading constant as shown in FIG. 21*d*.

Figure 23C:
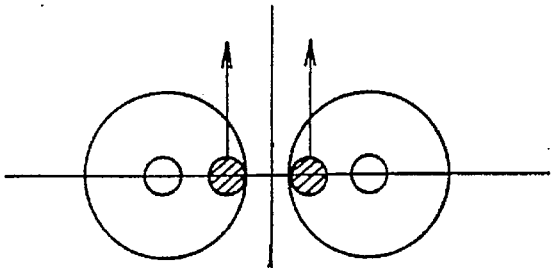
FIGS. 23*a*–23*c* are diagrams for explaining the correcting operation in the event that a turning sliding is caused during the forward movement of the machine proper.
Figure 23B:
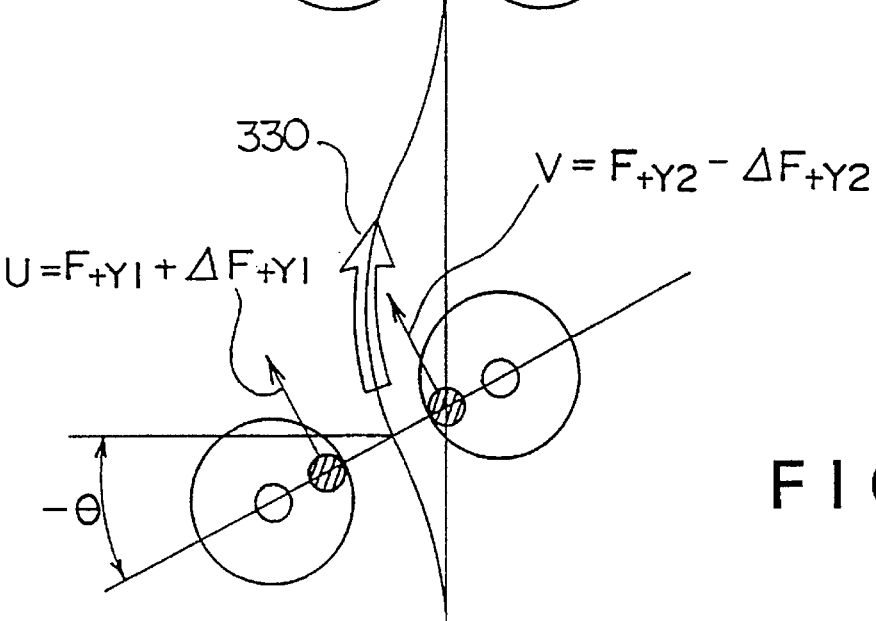
Figure 23A:
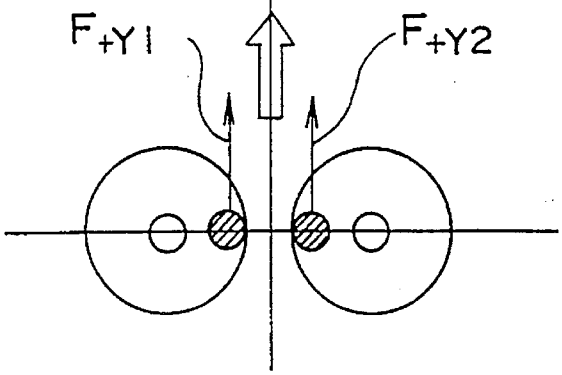

Also, in FIGS. 23*a*–23*c*, if, for example, a turning sliding motion of the −θ direction is caused as shown in FIG. 23*b* during the +Y forward movement ((a),(b)), the heading is corrected by performing a turning correction movement to the +θ direction 330 while adding turning correction tilts to the tilting commands $+Y_1$ and $+Y_2$ for the rotary shafts 28 and 28*a* thus correcting a propulsion U to become greater than a propulsion V and thereby moving the machine proper forward (c).

While, in the foregoing description, both of the rotary shafts 28 and 28*a* are caused to perform the turning correction operations, only either one of the rotary shafts may be caused to singly perform the turning correction operation as shown in FIG. 22.

The ±θ operations of the second stick 202 are used for forced turning operations. When turning commands (±θ operations) are applied by the second stick 202, the tilting controls of the rotary shafts proportional to the stick rotational angles are performed. Where the concrete floor surface is level, the application of the turning commands of the same amount for both sides causes the operation at a uniform turning speed, whereas if there are irregularities, slopes or the like in the concrete floor surface, the application of the turning commands of the same amount for both sides results in the operation at a nonuniform speed.

Figure 24:
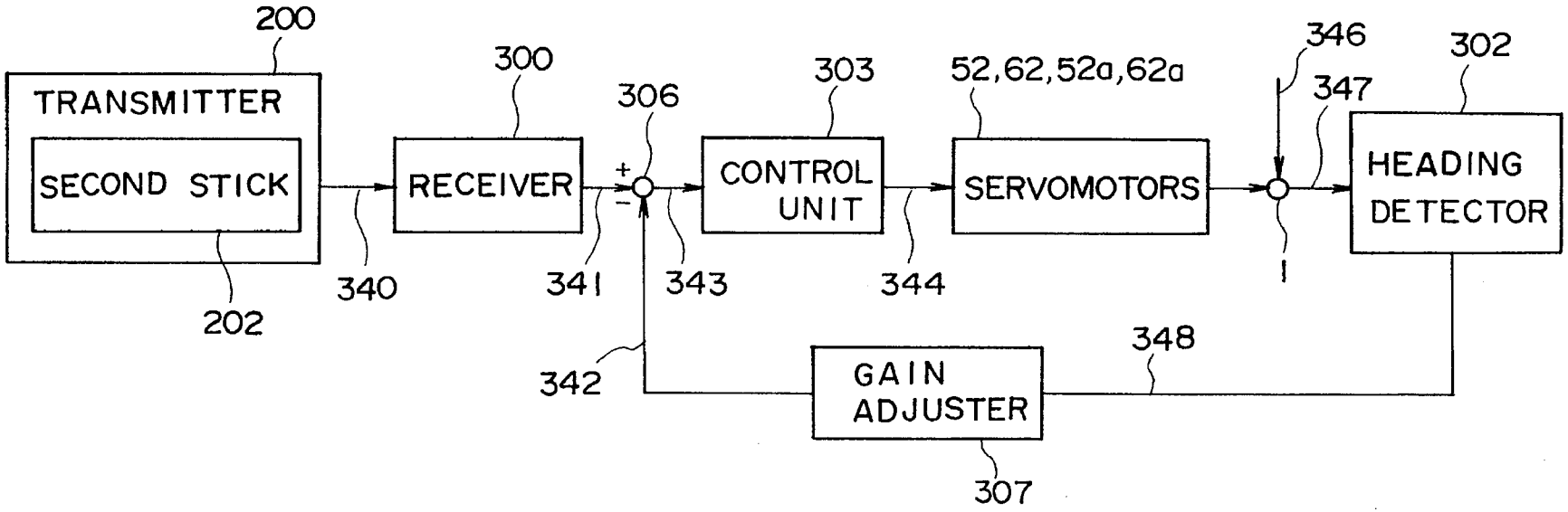
FIG. 24 is a block diagram showing still another embodiment of the control system according to the present invention.

Thus, the control system is constructed as shown in FIG. 24. In FIG. 24, numeral 306 designates a comparator whereby a turning angular velocity signal 348 generated from the vibratory gyro of the heading detector 302 is fed back through a gain adjuster 307 to a turning command (±θ operation) 340 by the second stick 202 of the transmitter 200. In other words, when the turning command 340 is applied to the receiver 300 by the second stick 202, a turning angular velocity command signal 341 consisting of a number of pulses corresponding to the ±θ operation is applied to the comparator 306. On the other hand, while the control unit 303 applies a tilt angle signal 344 according to the turning angular velocity command signal 341 to the servomotors 52, 62, 52*a* and 62*a* of the rotary shafts thereby causing a turning operation of the machine proper 1 according to the signal 344, if a disturbance 346 is applied to the machine proper 1 during the turning operation, a turning speed 347 of the machine proper 1 due to the disturbance 346 is detected by the heading detector 302 and it is applied as a turning angular velocity signal 348 from its vibratory gyro to the gain adjuster 307. The gain adjuster 307 converts the turning angular velocity signal 348 from the vibratory gyro to the corresponding number of pulses and applies this turning angular velocity signal 342 to the comparator 306. The comparator 306 obtains the deviation between the turning angular velocity command signal 341 from the receiver 300 and the turning angular velocity signal 342 from the gain adjuster 307, and in response to the resulting deviation signal 343 the control unit 303 performs the required tilting control of the rotary shafts, thereby preventing a variation of the turning speed due to the disturbance.

By thus feeding back the output turning angular velocity signal 348 from the vibrator gyro of the heading detector 302 to the turning command (±θ operation) 340 and thereby controlling the tilting of the rotary shafts in such a manner that the output turning angular velocity signal 348 from the vibratory gyro is made proportional to the stick operation angle, it is possible to perform a stable turning operation irrespective of irregularities, slopes, etc., in the concrete floor surface, if any.

What is claimed is:

1. A concrete-floor finisher comprising:

a supporting plate;

a plurality of rotary shafts supported on said supporting plate in such a manner that vertical axes thereof are tiltable, said rotary shafts being rotatable in opposite directions with respect to each other;

a fitting member for holding each of a plurality of blades radially arranged relative to a rotor at a lower part of each of said rotary shafts; and blade supporting means for coupling each said fitting member to each said blade so as to support substantially a central portion of a radial width of each said blade, each said blade being rockably supported by a pin extended in tangential direction of a circle of rotation of the supporting point.

2. A concrete-floor finisher according to claim 1, wherein each said blade supporting means serves as means adapted to be detachable as a unit with each said blade with respect to each said fitting member.

3. A concrete-floor finisher according to claim 1, wherein each said fitting member comprises a bent member, wherein each said bent blade supporting means is coupled to a forward end of each said bent member, wherein a bent portion of each said fitting member is rotatably supported by a bearing mounted on a lower surface of a base plate fastened to each said rotary shaft, wherein a rotor shaft is vertically slidably and rotation transmissively fitted into each said rotary shaft to vertically move each said rotor below said base plate, wherein a circular groove is formed in an outer periphery of each said rotor, and wherein a free end of each said fitting member is slidably fitted in the circular groove of each said rotor by arm means.

4. A concrete floor finisher according to claim 1, further comprising:

X-rocking means for tilting each said rotary shaft in an x direction;

Y-rocking means for tilting each said rotary shaft in a y direction;

heading detecting means for detecting a heading of a machine proper; and control means responsive to a signal from said heading detecting means to correct an amount of turning deviation of said machine proper from a predetermined heading and thereby to apply a corrected control signal to at least one of said X-rocking means and said Y-rocking means.

5. A concrete-floor finisher according to claim 4, wherein said heading detecting means comprises a north-seeking gyroscope.

6. A concrete-floor finisher according to claim 4, wherein said heading detecting means comprises a vibratory gyro and an integrating circuit.

7. A concrete-floor finisher according to claim 4, wherein said heading detecting means comprises a magnetic heading sensor.

8. A concrete-floor finisher according to claim 4, wherein said heading detecting means comprises an optical fiber gyroscope.

9. A concrete-floor finisher according to claim 4, further comprising:

receiving means for receiving a command signal sent from transmitting means by remote operation; and means whereby a turning angular velocity signal generated from said heading detecting means is fed back to and compared with a turning angular velocity command signal applied to said control means from said transmitting means through said receiving means thereby to correct the heading of said machine proper.

10. A concrete-floor finisher comprising:

a supporting plate;

a plurality of rotary shafts supported on said supporting plate in such a manner that vertical axes thereof are tiltable, said rotary shafts being rotatable in opposite directions with respect to each other;

plurality of blades each thereof being radially attached through a fitting member to a rotor at a lower part of each of said rotary shafts;

X-rocking means for tilting each said rotary shaft in an x direction;

Y-rocking means for tilting each said rotary shaft in a y direction;

heading detecting means for detecting a heading of a machine proper; and control means responsive to a signal from said heading detecting means to correct an amount of turning deviation of said machine proper from a predetermined heading and thereby to apply a corrected control signal to at least one of said X-rocking means and Y-rocking means.

11. A concrete-floor finisher according to claim 10, wherein said heading detecting means comprises a north-seeking gyroscope.

12. A concrete-floor finisher according to claim 10, wherein said heading detecting means comprises a vibratory gyro and an integrating circuit.

13. A concrete-floor finisher according to claim 10, wherein said heading detecting means comprises a magnetic heading sensor.

14. A concrete-floor finisher according to claim 10, wherein said heading detecting means comprises an optical fiber gyroscope.

15. A concrete-floor finisher according to claim 10, further comprising:

receiving means for receiving a command signal from transmitting means by remote operation; and means whereby a turning velocity signal generated from said heading detecting means is fed back to and compared with a turning angular velocity command signal applied to said control means from said transmitting means through said receiving means thereby correcting the heading of said machine proper.

* * * * *